US007834294B2

(12) United States Patent
Shirai et al.

(10) Patent No.: US 7,834,294 B2
(45) Date of Patent: Nov. 16, 2010

(54) HEATING DEVICE AND SANITARY WASHING DEVICE USING THE SAME

(75) Inventors: Shigeru Shirai, Yamabe-gun (JP); Tomohide Matsumoto, Yamatotakada (JP); Kazushige Nakamura, Yamatokoriyama (JP); Mitsuyuki Furubayashi, Yamatokoriyama (JP); Takemi Oketa, Katano (JP)

(73) Assignee: Panasonic Corporation, Osaka (JP)

( * ) Notice: Subject to any disclaimer, the term of this patent is extended or adjusted under 35 U.S.C. 154(b) by 650 days.

(21) Appl. No.: 10/547,388

(22) PCT Filed: Mar. 1, 2004

(86) PCT No.: PCT/JP2004/002508

§ 371 (c)(1),
(2), (4) Date: Aug. 31, 2005

(87) PCT Pub. No.: WO2004/079275

PCT Pub. Date: Sep. 16, 2004

(65) Prior Publication Data

US 2006/0151458 A1 Jul. 13, 2006

(30) Foreign Application Priority Data

Mar. 5, 2003 (JP) ..... 2003-059157

(51) Int. Cl.
*H05B 3/06* (2006.01)

(52) U.S. Cl. ..... 219/217; 219/523

(58) Field of Classification Search ..... 219/217, 219/523; 392/465, 478, 488, 480, 485
See application file for complete search history.

(56) References Cited

U.S. PATENT DOCUMENTS

| | | | | |
|---|---|---|---|---|
| 4,237,560 | A * | 12/1980 | Riegelman et al. | 4/447 |
| 5,559,924 | A | 9/1996 | Kadotani et al. | |
| 5,740,315 | A * | 4/1998 | Onishi et al. | 392/489 |
| 2003/0140407 | A1 | 7/2003 | Matsumoto et al. | |

FOREIGN PATENT DOCUMENTS

| | | |
|---|---|---|
| CN | 2358403 | 1/2000 |
| JP | 48-108448 | 3/1973 |
| JP | 52-037339 | 9/1977 |
| JP | 5-231712 | 9/1993 |

(Continued)

OTHER PUBLICATIONS

A partial English language translation of Japanese Laid-Open Utility Model No. HEI 6-82715.

(Continued)

*Primary Examiner*—Tu B Hoang
*Assistant Examiner*—Vinod D Patel
(74) *Attorney, Agent, or Firm*—Greenblum & Bernstein P.L.C.

(57) ABSTRACT

Linear-type sheathed heaters are arranged substantially in parallel with each other in a case body. Regions near the ends of the outer peripheral surface of each of the sheathed heaters are held by elastic holding members so as to move in the axial direction. A cylindrical space is formed between the outer peripheral surface of each of the sheathed heater and the case body. A space is provided that communicates the cylindrical spaces.

15 Claims, 16 Drawing Sheets

FOREIGN PATENT DOCUMENTS

| | | |
|---|---|---|
| JP | 6-221677 | 8/1994 |
| JP | 6-82175 | 11/1994 |
| JP | 7-98152 | 4/1995 |
| JP | 7-098152 | 4/1995 |
| JP | 10-160249 | 6/1998 |
| JP | 2000-38757 | 2/2000 |
| JP | 2000-038757 | 2/2000 |
| JP | 2000-64399 | 2/2000 |
| JP | 2000-064399 | 2/2000 |
| JP | 2001-115531 | 4/2001 |
| JP | 2001-336203 | 12/2001 |

OTHER PUBLICATIONS

English Language Abstract of JP 10-160249.
English Language Abstract of JP 2001-336203.
English Language Abstract of JP 7-98152.
English Language Abstract of JP 2000-064399.
English Language Abstract of JP 2000-038757.
English Language Abstract of JP 2001-115531.
U.S. Appl. No. 10/525,770 to Shirai et al., filed on Feb. 28, 2005.
Partial English Language Translation of JP 2001-336203.
English language partial translation of JP 7-98152, Apr. 11, 1995.
English language partial translation of JP 2000-64399, Feb. 29, 2000.
English language partial translation of JP 2000-38757, Feb. 8, 2000.
English language partial translation of JP 2001-115531, Apr. 24, 2001.
English language partial translation of JP 6-82175, Nov. 25, 1994.
English language Abstract of JP 6-221677, Aug. 12, 1994.
English language partial translation of CN 2358403 Y.
Front page of the pamphlet of the Announced Patent Specification in the counterpart Chinese Patent Application No. 2004-80005916.0, May 12, 2010.
Partial English language translation of JP 48-108448.
Partial English language translation of JP 6-221677.

* cited by examiner (a)
(b)
(c)
11a
Y
Y
Z
Z
511
512a
600
504a
600b
P6
P2
P4
12b
505a
510a
P3
600a
P1
P5
505b
510b
510c

HEATING DEVICE AND SANITARY WASHING DEVICE USING THE SAME

TECHNICAL FIELD

The present invention relates to a heating device and a sanitary washing apparatus comprising the heating device.

BACKGROUND ART

A sanitary washing apparatus for washing the private part of the human body comprises a heating device that adjusts the temperature of washing water for use in washing to an appropriate temperature in order not to give an unpleasant feeling to the human body. Examples of the heating device principally include a hot water storage type sanitary washing apparatus and an instantaneous heating type sanitary washing apparatus.

The hot water storage type sanitary washing apparatus comprises a hot water tank that stores a predetermined amount of washing water beforehand while heating the washing water to a predetermined temperature with a built-in heater. In washing the private part of the human body, a method is employed in which the washing water heated to the predetermined temperature beforehand in the hot water tank is fed to a nozzle from which the washing water is sprayed, using the tap water pressure or by a pump or the like.

In the hot water storage type sanitary washing apparatus, the washing water in the hot water tank has to be continuously kept at the predetermined temperature beforehand until the time of washing the private part of the human body. This requires power to be continuously supplied to the heating device, resulting in increased power consumption. In addition, when a plurality of persons successively wash their private parts to use up more than the amount of washing water that is heated beforehand to the predetermined temperature in the hot water tank, the temperature of the washing water in the hot water tank decreases below the predetermined temperature to give an unpleasant feeling to the human bodies.

On the other hand, the instantaneous heating type sanitary washing apparatus comprises a heating device that is quick at increasing the temperature of washing water, such as a ceramic heater. In washing the private part of the human body, a method is employed in which the washing water is instantaneously heated to a predetermined temperature by the heating device, and fed to a nozzle from which the washing water is sprayed, using the tap water pressure or a pump or the like.

In the instantaneous heating type sanitary washing apparatus, therefore, the washing water does not have to be continuously kept at the predetermined temperature beforehand. Power supply to the heating device is necessary only during the use, which results in reduced power consumption. Moreover, even if a large amount of washing water is used for washing the private parts of the human bodies by, e.g., long-time washing or continuous use of the toilet, the temperature of the washing water can be prevented from decreasing below the predetermined temperature to give an unpleasant feeling to the human bodies (refer to JP 10-160249 A).

A heating device typically has a configuration in which a heating element is held in a case body. When this heating device is used to instantaneously heat washing water, the heating device thermally expands instantaneously, and contracts after the heating is completed. This causes a great stress to be instantaneously applied to the case body. As a result, the heating element or the case body may be damaged or deform.

DISCLOSURE OF THE INVENTION

An object of the invention is to provide a heating device whose heating element and case body are prevented from deformation and damage even when the heating element thermally expands or contracts, and a sanitary washing apparatus using such a heating device.

A heating device according to one aspect of the invention comprises a case body, a heating element having a first end and a second end that is provided to pass through the case body, a first holding member that holds the first end of the heating element to the case body so as to move in an axial direction, and a second holding member that holds the second end of the heating element to the case body so as to move in the axial direction.

In the heating device, the heating element is provided so as to pass through the case body. The first end of the heating element is held to the case body by the first holding member so as to move in the axial direction while the second end of the heating element is held to the case body by the second holding member so as to move in the axial direction.

When the heating element thermally expands or contracts in the axial direction in this case, the first end of the heating element slides on the first holding member, and the second end thereof slides on the second holding member. Thus, a stress is not exerted on the heating element and the case body, preventing damage to and deformation of the heating element and the case body.

A flow path that allows flow of liquid may be formed between the case body and an outer peripheral surface of the heating element.

In this case, the flow of liquid between the case body and the outer peripheral surface of the heating element increases the contact area between the liquid and the heating element. This allows efficient heating of the liquid. Moreover, since the outer periphery of the heating element is not in contact with the case body, a stress is not exerted on the heating element and the case body even if the heating element thermally expands or contracts in the radial direction, thus preventing damage to and deformation of the heating element and the case body. In addition, members for making the flow path are not required, thus allowing a reduction in the parts count, and a reduction in the assembly time.

A first liquid port and a second liquid port that communicate with the flow path may be formed in the case body.

Since the first liquid port and the second liquid port that communicate with the flow path are thus formed in the case body, the assembly time can be reduced.

The first liquid port in the case body may be provided in a position off-center from the central axis of the heating element.

In this case, the liquid supplied from the first liquid port circulates along the peripheral surface of the heating element in the circumferential direction. This allows efficient transmission of heat to the liquid from the heating element due to the mixing effect on the surface of the heating element. As a result, high thermal conversion efficiency can be obtained. The size of the heating device can therefore be reduced.

The heating device may further comprise a temperature detector that is provided near the second liquid port in the case body.

This allows a measurement of the temperature of the washing water flowing from the second liquid port, so as to properly control the temperature of the washing water heated by the heating element.

The heating device may further comprise a temperature buffer that is provided in the case body to communicate with the second liquid port.

This allows reductions in the temperature fluctuations in the washing water heated by the heating element, thus allowing the temperature of the washing water to be constant.

The heating element may be formed in a columnar shape. This simplifies the configuration of the heating element to facilitate the manufacture of the heating element. Moreover, the heating element is deformed only in the axial direction in case of thermal expansion or contraction. This allows the deformation of the heating element due to thermal expansion or contraction to be absorbed by sliding of the first end of the heating element on the first holding member and sliding of the second end thereof on the second holding member.

The heating element may include a sheathed heater. This results in low-cost manufacture of a heating device that is difficult to break.

The heating element may include a ceramic heater. This results in the manufacture of a reliable heating device.

The heating element may include a plurality of substantially linear-shaped heating elements, and the plurality of heating elements may be provided in parallel to pass through the case body.

This allows making of a heating device that is small and produces a large amount of heat while allowing flicker noise to be reduced by controlling the power supplied to a plurality of heating elements.

Each of the first holding member and the second holding member may be composed of an elastic body. In this case, regions near the first and second ends of the heating element are held by the first and second holding members, respectively, each composed of an elastic body. This ensures that the ends of the heating element are slidably held. As a result, the heating element is slidably held.

The case body may be formed by integrating a plurality of case portions. This allows a reduction in the assembly time of the heating device while facilitating the assembly. This allows automatic assembly.

The plurality of case portions may be made of resins, and integrated by being bonded by welding. This allows a reduction in the assembly time while achieving a cost reduction.

The heating device may further comprise an overheating preventing device for preventing the heating element from overheating. This prevents the heating element from abnormally overheating to improve safety.

A sanitary washing apparatus according to another aspect of the invention, which sprays washing water supplied from a water supply source to a portion of a human body to be washed, comprises a heating device that heats the washing water supplied from the water supply source while causing the washing water to flow, and a spraying device that sprays the washing water heated by the heating device to the human body, wherein the heating device comprises a case body, a heating element having a first end and a second end that is provided to pass through the case body, a first holding member that holds the first end of the heating element to the case body so as to move in an axial direction, and a second holding member that holds the second end of the heating element to the case body so as to move in the axial direction.

In the sanitary washing apparatus, the washing water supplied from the water supply source is heated while being caused to flow by the heating device, and the washing water heated by the heating device is sprayed from the spraying device to the human body.

In this case, the washing water is heated only during the use of the sanitary washing apparatus, so that the power consumption can be minimized. Moreover, a storage tank for storing the washing water is not necessary, thus resulting in space savings. Further, even when the washing time is long, reduction in the temperature of the washing water can be prevented.

In the heating device, the heating element is provided so as to pass through the case body. The first end of the heating element is held to the case body by the first holding member so as to move in the axial direction while the second end thereof is held to the case body by the second holding member so as to move in the axial direction.

In this case, the first end slides on the first holding member, and the second end slides on the second holding member when the heating element thermally expands or contracts in the axial direction. Thus, a stress is not exerted on the heating element and the case body, preventing damage to and deformation of the heating element and the case body.

BEST MODE FOR CARRYING OUT THE INVENTION

A sanitary washing apparatus according to an embodiment of the present invention will be described below.

Figure 1:
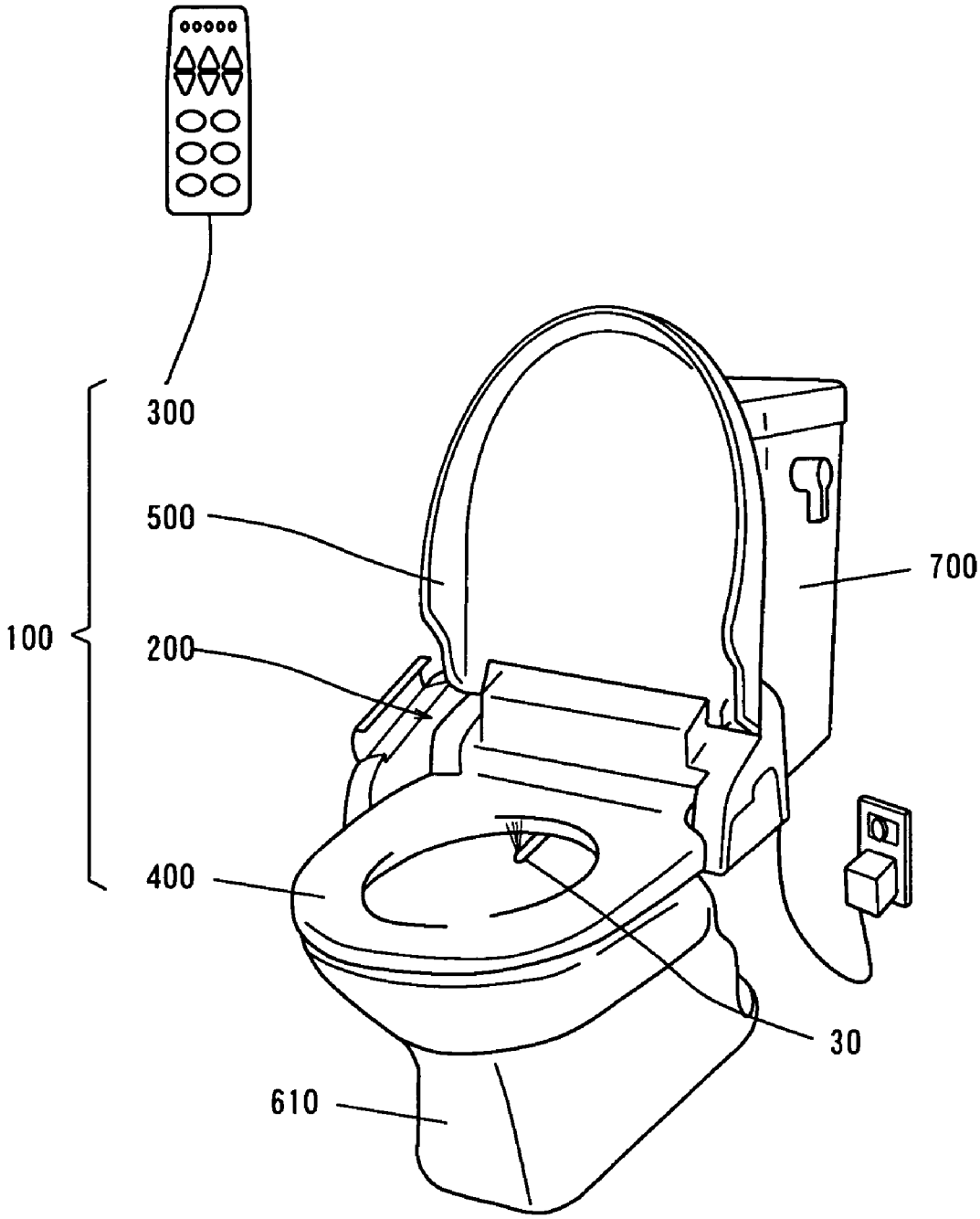
FIG. 1 is a perspective view showing a state in which a sanitary washing apparatus according to an embodiment of the invention is mounted on a toilet bowl.

FIG. 1 is a perspective view showing a state in which a sanitary washing apparatus according to an embodiment of the invention is mounted on a toilet bowl.

As shown in FIG. 1, the sanitary washing apparatus 100 is mounted on the toilet bowl 610. A tank 700 is connected to a tap water pipe for supplying washing water into the toilet bowl 610.

The sanitary washing apparatus 100 comprises a main body 200, a remote control device 300, a toilet seat 400, and a cover 500.

The main body 200 is attached with the toilet seat 400 and the cover 500 that can be opened and closed. The main body 200 is also provided with a washing water supply mechanism that includes a nozzle unit 30, and also contains a controller. The controller in the main body 200 controls the washing water supply mechanism based on a signal transmitted from the remote control device 300 as described below. The controller in the main body 200 also controls, e.g., a heater contained in the toilet seat 400, and a deodorizing device (not shown) and a hot air supply device (not shown) provided in the main body 200.

Figure 2:
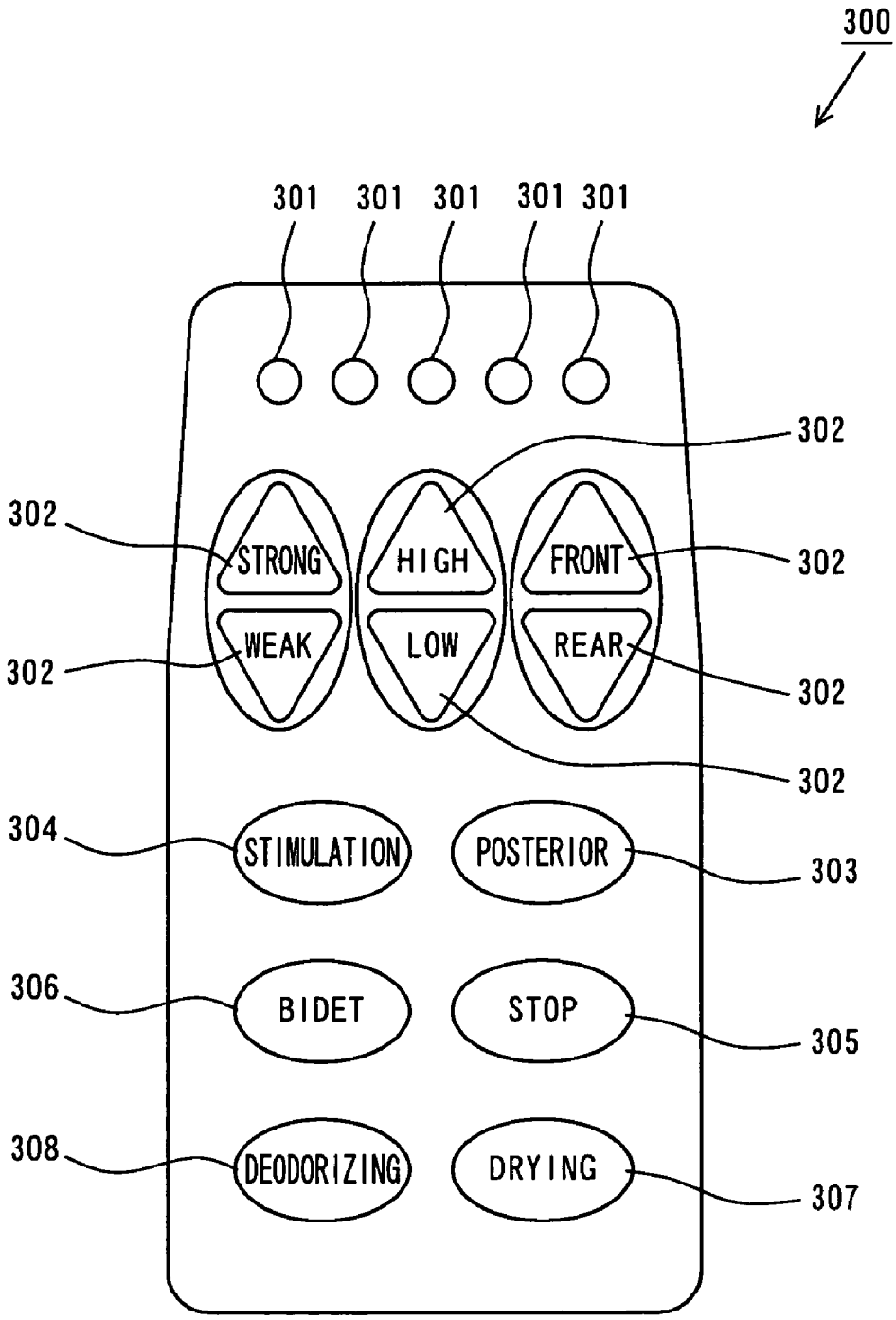
FIG. 2 is a schematic diagram showing an example of the remote control device of FIG. 1.

FIG. 2 is a schematic diagram showing an example of the remote control device 300 of FIG. 1.

As shown in FIG. 2, the remote control device 300 comprises a plurality of LED (Light Emitting Diodes) 301, a plurality of adjustment switches 302, a posterior switch 303, a stimulation switch 304, a stop switch 305, a bidet switch 306, a drying switch 307, and a deodorizing switch 308.

A user presses the adjustment switches 302, posterior switch 303, stimulation switch 304, stop switch 305, bidet switch 306, drying switch 307, and deodorizing switch 308. This causes the remote control device 300 to wirelessly transmit a predetermined signal to a controller in the main body 200 of the sanitary washing apparatus 100 mentioned below. The controller in the main body 200 receives the predetermined signal that is wirelessly transmitted from the remote control device 300, and controls the washing water supply mechanism and the like.

When, for example, the posterior switch 303 or bidet switch 306 is switched by the user, the nozzle unit 30 in the main body 200 of FIG. 1 moves so as to spray washing water. When the stimulation switch 304 is pressed, the nozzle unit 30 in the main body 200 of FIG. 1 sprays washing water so as to stimulate the private part of the human body. When the stop switch 305 is pressed, the nozzle unit 30 stops spraying washing water.

When the drying switch 307 is pressed, the hot air supply device (not shown) in the sanitary washing apparatus 100 sprays hot air toward the private part of the human body. When the deodorizing switch 308 is pressed, the deodorizing device (not shown) in the sanitary washing apparatus 100 removes odors from its surroundings.

When the adjustment switches 302 are pressed by the user, the position of the nozzle unit 30 in the main body 200 in the sanitary washing apparatus 100 of FIG. 1 is changed, the temperature of the washing water sprayed from the nozzle unit 30 is changed, or the pressure of the washing water sprayed from the nozzle unit 30 is changed. Moreover, when the adjustment switches 302 are pressed, the plurality of LEDs (Light Emitting Diodes) are turned on.

Figure 3:
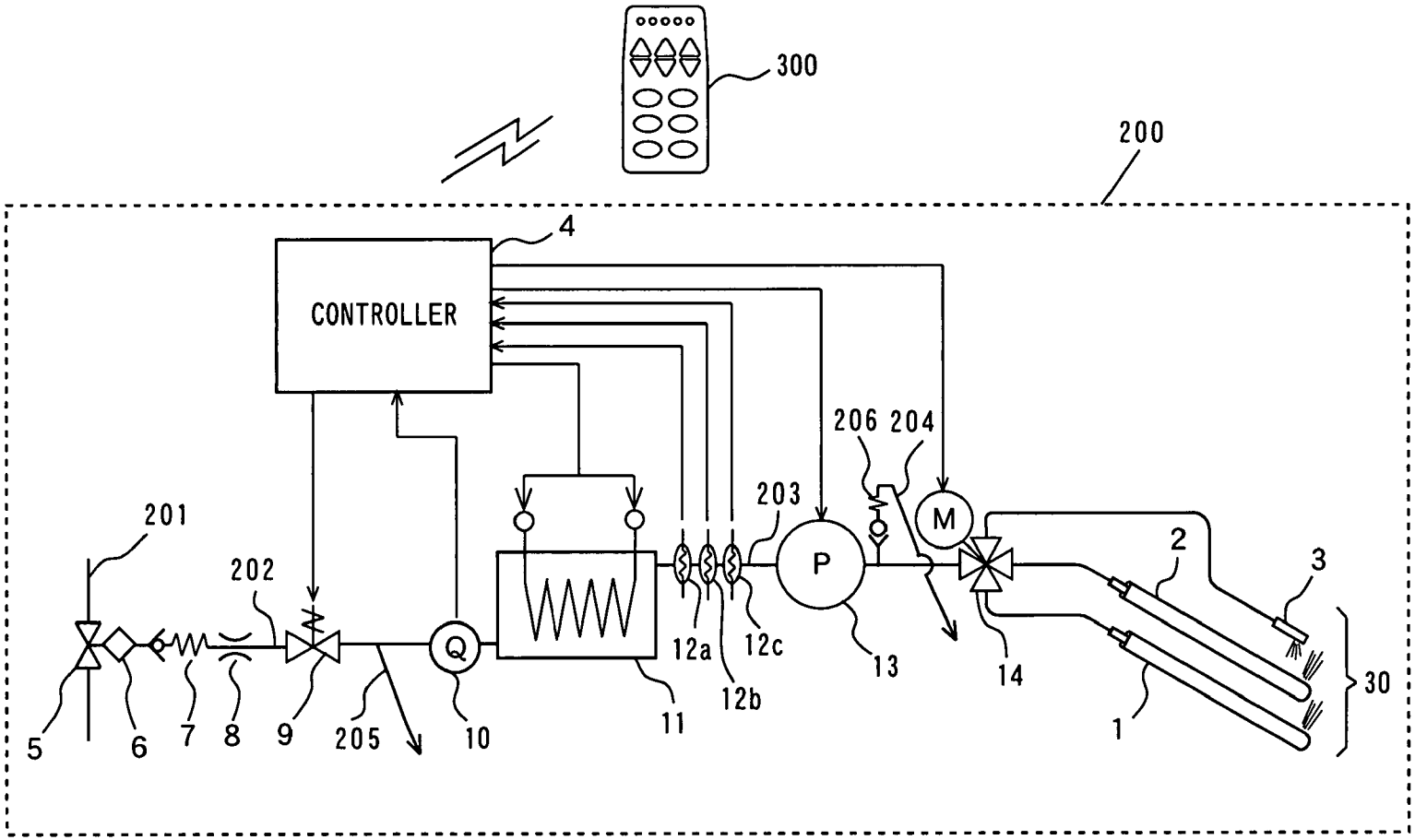
FIG. 3 is a schematic diagram showing the configuration of the main body of the sanitary washing apparatus according to the embodiment of the invention.

The main body 200 of the sanitary washing apparatus 100 according to the embodiment of the invention will be described below. FIG. 3 is a schematic diagram showing the configuration of the main body 200 of the sanitary washing apparatus 100 according to the embodiment of the invention.

The main body 200 shown in FIG. 3 includes a controller 4, a branched water faucet 5, a strainer 6, a check valve 7, a constant flow valve 8, a stop solenoid valve 9, a flow sensor 10, a heat exchanger 11, a temperature sensor 12*a*, a thermostat 12*b*, a temperature fuse 12*c*, a pump 13, a switching valve 14, and a nozzle unit 30. The nozzle unit 30 includes a posterior nozzle 1, a bidet nozzle 2, and a nozzle cleaning nozzle 3.

As shown in FIG. 3, the branched water faucet 5 is inserted into the tap water pipe 201. The strainer 6, check valve 7, constant flow valve 8, stop solenoid valve 9, flow sensor 10, and temperature sensor 12*a* are inserted in this order into a pipe 202 that is connected between the branched water faucet 5 and the heat exchanger 11. In addition, the temperature sensor 12*b* and the pump 13 are inserted into a pipe 203 that is connected between the heat exchanger 11 and the switching valve 14.

Clean water flowing through the tap water pipe 201 is first supplied as washing water to the strainer 6 via the branched water faucet 5. The strainer 6 removes dirt, impurities, and the like included in the washing water. Then, the check valve 7 prevents the washing water in the pipe 202 from flowing backward. The constant flow valve 8 subsequently keeps the flow rate of the washing water flowing in the pipe 202 constant.

A relief pipe 204 is branched from the pipe connected between the pump 13 and the switching valve 14, and a relief water pipe 205 is branched from the pipe connected between the stop solenoid valve 9 and the flow sensor 10. A relief valve 206 is inserted into the relief pipe 204. The relief valve 206 is opened when the pressure, particularly at the downstream side, in the pump 13 exceeds a predetermined value, thereby preventing problems such as damage to equipment under abnormal conditions and the disconnection of a hose. Meanwhile, of the washing water that is supplied after its flow rate has been adjusted by the constant flow valve 8, washing water that is not sucked by the pump 13 is discharged from the water pipe 205. This causes a predetermined back pressure to be exerted in the pump 13 without depending on the water supply pressure.

The flow sensor 10 then measures the flow rate of the washing water flowing in the pipe 202, and feeds the measured flow rate value to the controller 4. Meanwhile, the temperature sensor 12*a* measures the temperature of the washing water flowing in the pipe 202, and feeds the measured temperature value to the controller 4.

The heat exchanger 11 subsequently heats the washing water supplied via the pipe 202 to a predetermined temperature based on a control signal that is fed from the controller 4. The thermostat 12*b* measures the temperature of the washing water heated to the predetermined temperature by the heat exchanger 11, and feeds a temperature exceeding signal to the controller 4 when the temperature exceeds the predetermined temperature. The controller 4 shuts off the power supply to the heat exchanger 11. The temperature fuse 12*c* detects the temperature of sheathed heaters in the heat exchanger 11, and shuts off the power supply to the sheathed heaters when the temperature exceeds a predetermined temperature.

The pump 13 feeds by pressure the washing water heated by the heat exchanger 11 to the switching valve 14 based on the control signal that is fed from the controller 4. The switching valve 14 supplies the washing water to any one of the posterior nozzle 1, bidet nozzle 2, and nozzle cleaning nozzle 3 in the nozzle unit 30 based on the control signal fed from the controller 4. This causes any one of the posterior nozzle 1, bidet nozzle 2, and nozzle cleaning nozzle 3 to spray the washing water.

The controller 4 feeds the control signal to the stop solenoid valve 9, heat exchanger 11, pump 13, and switching valve 14 based on the signal wirelessly transmitted from the remote control device 300 of FIG. 1, the measured flow rate value fed from the flow sensor 10, the measured temperature value from the temperature sensor 12*a*, and the temperature exceeding signal from the thermostat 12*b*.

Figure 4:
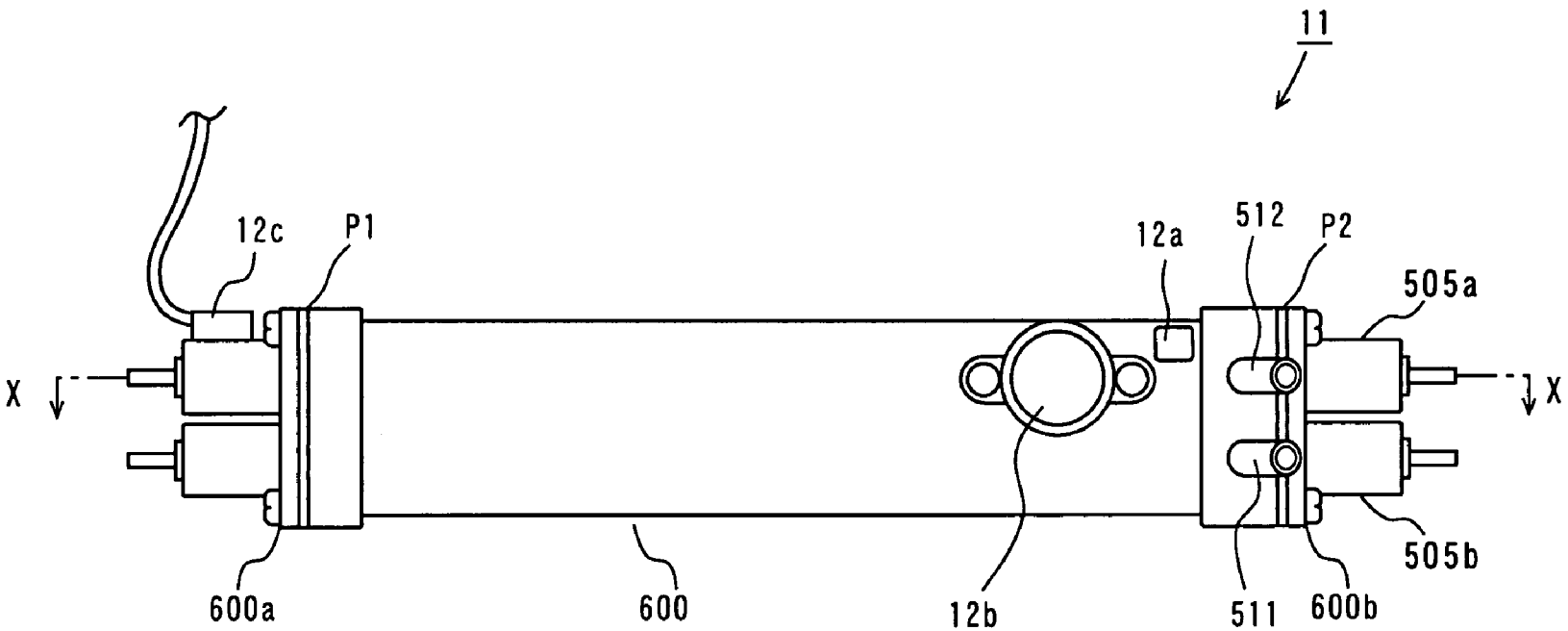
FIG. 4 is a plan view showing an example of the configuration of a heat exchanger.

FIG. 4 is a plan view showing an example of the configuration of the heat exchanger 11.

As shown in FIG. 4, the heat exchanger 11 mainly comprises a case body 600 having a rectangular shape, linear type sheathed heaters 505*a* and 505*b*, plates P1, P2, and end surface members 600*a*, 600*b*.

A washing water inlet 511 for receiving the washing water that is supplied from the pipe 202 and a washing water outlet 512 for feeding heated washing water to the pump 13 are arranged on the upper surface of one end of the case body 600 of the heat exchanger 11.

A temperature sensor 12*a* and a thermostat 12*b* are arranged near the washing water outlet 512. A temperature fuse 12*c* is arranged on the other end of the sheathed heater 505*a*.

The end surface members 600*a*, 600*b* are attached on the end surfaces of the case body 600 with the plates P1, P2, respectively, being sandwiched therebetween. In this way, clearances between openings in the ends of the case body 600 and the sheathed heater 505*a* and clearances between openings in the ends of the case body 600 and the sheathed heater 505*b* mentioned below are blocked off.

Figure 5:
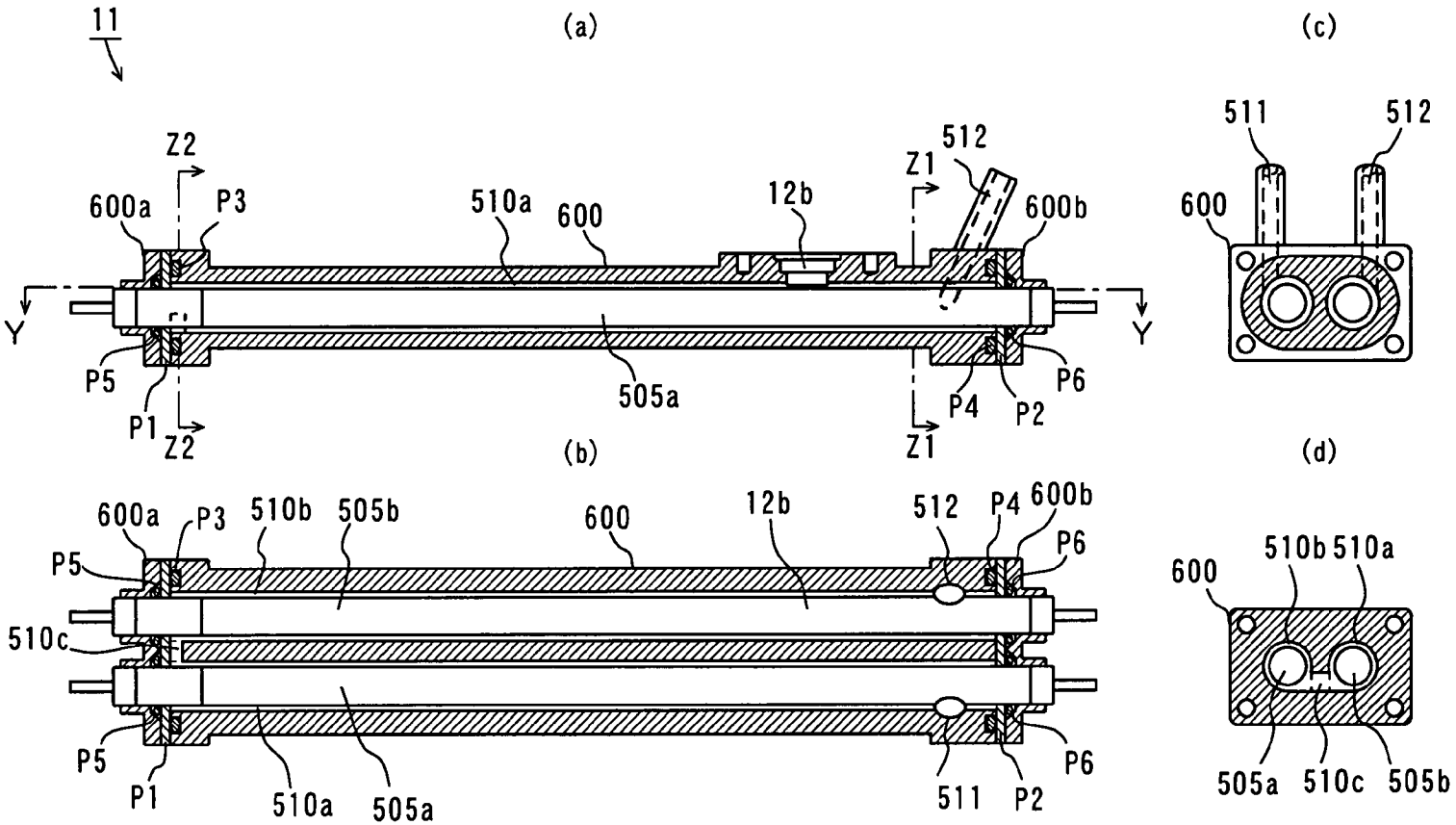
FIG. 5 is a diagram for use in illustrating the inside configuration of the heat exchanger shown in FIG. 4.

Now refer to FIG. 5 that is a diagram for use in illustrating the inside configuration of the heat exchanger 11 shown in FIG. 4. FIG. 5(*a*) shows the cross section of the heat exchanger 11 along the line X-X of FIG. 4, FIG. 5(*b*) shows the cross section of the heat exchanger 11 along the line Y-Y of FIG. 5(*a*), FIG. 5(*c*) shows the cross section of the heat exchanger 11 along the line Z1-Z1 of FIG. 5(*a*), and FIG. 5(*d*) shows the cross section of the heat exchanger 11 along the line Z2-Z2 of FIG. 5(*a*).

The linear type sheathed heaters 505*a*, 505*b* are arranged substantially in parallel so as to pass through the inside of the case body 600. A cylindrical space 510*a* is formed between the outer peripheral surface of the sheathed heater 505*a* and the case body 600, and a cylindrical space 510*b* is formed between the outer peripheral surface of the sheathed heater 505*b* and the case body 600. A space 510*c* is also provided that communicates the cylindrical spaces 510*a*, 510*b*.

O rings P3 are arranged between an end surface of the case body 600 and the plate 1, and O rings 4 are arranged between the other end surface and the plate P2. O rings P5 are arranged between the end surface member 600*a* and the plate P1, and O rings P6 are arranged between the end surface member 600*b* and the plate P2. This prevents the washing water from flowing out through the joint of the end surface of the case body 600 and the end surface member 600*a*, and the joint of the other end surface and the end surface member 600*b*.

Moreover, regions near the ends of the outer peripheral surface of each of the sheathed heaters 505*a*, 505*b* are held by the elastic holding member P5 and the elastic holding member P6, respectively, so as to move in the axial direction. As mentioned here, the state of being held to move in the axial direction is, for example, a state in which the sheathed heaters 505*a*, 505*b* are held to move in the axial direction by bending of the elastic holding members P5, P6 made of rubber or a state in which the sheathed heaters 505*a*, 505*b* are held to move in the axial direction by sliding of surfaces of the sheathed heaters 505*a*, 505*b* on surfaces of their respective elastic holding members P5, P6 made of rubber. The regions near the ends of the outer peripheral surface of each of the sheathed heaters 505*a*, 505*b* corresponds, not to a portion including a nichrome wire for use as heating elements, but to metal terminals connected to the nichrome wire. Accordingly, the temperature near the ends of each of the sheathed heaters 505*a*, 505*b* does not increase. The elastic holding members P5, P6 are thus prevented from melting.

The controller 4 in FIG. 3 controls the temperature of the sheathed heaters 505*a*, 505*b* in the heat exchanger 11 by feedback control, based on the measured temperature value fed from the temperature sensor 12*a*. The detector of the thermostat 12*b* is inserted into the cylindrical space 510*b*. The controller 4 controls whether the power to the sheathed heaters 505*a*, 505*b* in the heat exchanger 11 is supplied or shut off, based on the temperature exceeding signal fed from the thermostat 12*b*.

The temperature fuse 12*c* shuts off the power to the sheathed heaters 505*a*, 505*b* when the temperature in the sheathed heater 505*b* exceeds a predetermined temperature. The temperature sensor 12*a*, arranged near the washing water outlet 512, is capable of accurately controlling the temperature of the washing water supplied to the posterior nozzle 1. In this way, the sheathed heaters 505*a*, 505*b* are prevented from being abnormally overheated, thus resulting in improved safety.

Further, since the thermostat 12*b* is arranged near the washing water outlet 512 similarly to the temperature sensor 12*a*, the controller 4 is capable of accurately controlling the temperature of the washing water supplied to the posterior nozzle 1.

The washing water is supplied to the cylindrical space 510*a* that is formed around the sheathed heater 505*a* from the washing water inlet 511 arranged at one end of the heat exchanger 11 in FIG. 5(*c*). The washing water inlet 511 is arranged in a position off-center from the axial center of the cylindrical space 510*a*. This causes the washing water to flow in the circumferential direction along the outer peripheral surface of the sheathed heater 505*a* inside the cylindrical space 510*a*. This allows efficient transmission of heat to the washing water from the sheathed heater 505*a*.

As shown in FIG. 5(*d*), the space 510*c* is also arranged in a position off-center from the axial center of each of the cylindrical spaces 510*a*, 510*b*. This causes the washing water flowing in the cylindrical space 510*a* to flow in the circumferential direction along the outer peripheral surface of the sheathed heater 505*b* inside the cylindrical space 510*b*. This allows efficient transmission of heat to the liquid from the sheathed heaters 505*a*, 505*b* due to the mixing effect on the surfaces of the sheathed heaters 505*a*, 505*b*. This results in efficient transmission of the heat to the washing water from the sheathed heater 505*b*.

The washing water that is heated efficiently by the sheathed heater 505*a* while flowing in the cylindrical space 510*a* is supplied to the space 510*b* around the sheathed heater 505*b* via the space 510*c*. Then, the washing water is further heated by the sheathed heater 505*b* efficiently while flowing in the cylindrical space 510*b*, and discharged from the washing water outlet 512.

In this case, even when the sheathed heaters 505*a*, 505*b* thermally expand or contract in the axial direction, the sheathed heaters 505*a*, 505*b* deform almost only in the axial direction. This allows the deformation of each of the sheathed heaters 505*a*, 505*b* due to thermal expansion or contraction to be efficiently absorbed by sliding of the ends of each of the sheathed heaters 505*a*, 505*b* on the elastic holding members P5, P6. Accordingly, no stress is exerted on the sheathed heaters 505*a*, 505*b* and the rectangular case body 600, preventing damage to and deformation of the sheathed heaters 505*a*, 505*b* and the rectangular case body 600.

In addition, the outer peripheries of the sheathed heaters 505*a*, 505*b* are not in contact with the rectangular case body 600, so that even if the sheathed heaters 505*a*, 505*b* thermally expand or contract in the radial direction, no stress is exerted on the sheathed heaters 505*a*, 505*b* and the case body 600, thus preventing damage to and deformation of the sheathed heaters 505*a*, 505*b* and the case body 600.

Although in this embodiment the controller 4 controls the temperature of the sheathed heaters 505*a*, 505*b* in the heat exchanger 11 by feedback control, the invention is not limited to the same. Alternatively, the temperature of the sheathed heaters 505*a*, 505*b* may be controlled by feed forward control. Still alternatively, controlling the sheathed heaters 505*a*, 505*b* by feed forward control when the temperature increases may be combined with controlling the sheathed heaters 505*a*, 505*b* by feedback control under normal conditions.

Still alternatively, a plurality of sheathed heaters 505*a*, 505*b* may be provided so that the amounts of power thereto are controlled by a triac device. For example, duty ratios may be set for the plurality of sheathed heaters 505*a*, 505*b*, respectively, so that the plurality of sheathed heaters 505*a*, 505*b* are controlled to receive power alternately according to their duty ratios. As a result, the generation of flicker noise, for example, can be reduced.

Although the two linear type sheathed heaters 505*a*, 505*b* which are inexpensive and difficult to break are used in this embodiment, the invention is not limited to the same. For example, any number of other linear type sheathed heaters may be used. Further, although the columnar sheathed heaters 505*a*, 505*b* are used in this embodiment, the invention is not limited to the same. For example, sheathed heaters having the shape of a triangular prism, a square prism, or a multiple prism may be used.

Further, although the sheathed heaters 505*a*, 505*b* are used in this embodiment, the invention is not limited to the same. For example, ceramic heaters having a cylindrical shape similar to that of the sheathed heaters 505*a*, 505*b* may be used.

Figure 6:
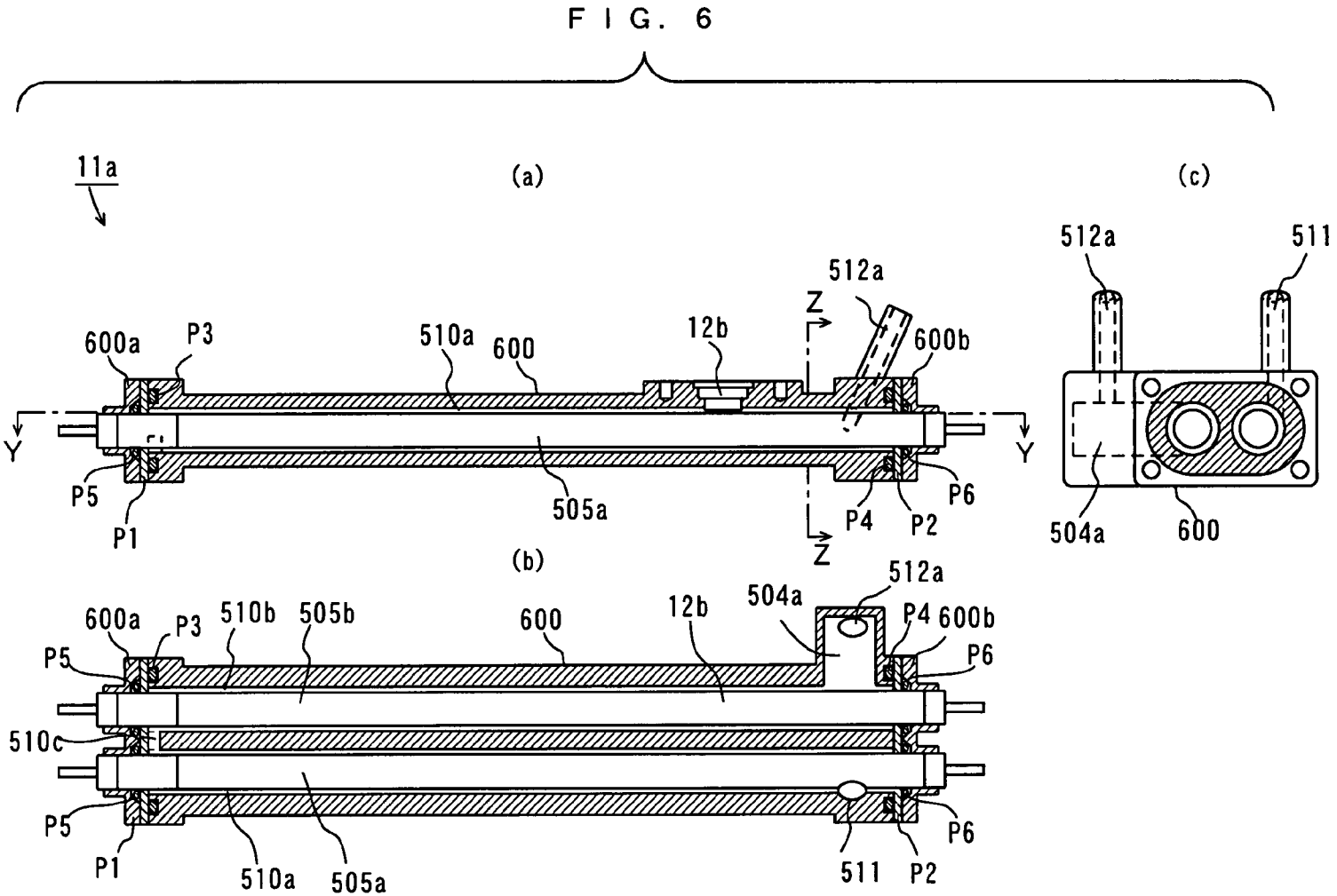
FIG. 6 is a cross section showing another example of the heat exchanger shown in FIG. 5.

Now refer to FIG. 6 that is a cross section showing another example of the heat exchanger shown in FIG. 5. FIG. 6(*a*) is a cross section showing another example of the heat exchanger shown in FIG. 5, FIG. 6(*b*) is a cross section showing the heat exchanger along the line Y-Y of FIG. 6(*a*), and FIG. 6(*c*) is a cross section showing the heat exchanger along the line Z-Z of FIG. 6(*a*). The heat exchanger 11*a* shown in FIG. 6 differs from the heat exchanger 11 shown in FIG. 5 as follows.

As shown in FIG. 6, a temperature buffer 504*a* is formed between a cylindrical space 510*b* and a washing water outlet 512*a* integrally with a rectangular case body 600. Washing water heated in cylindrical spaces 510*a*, 510*b*, and 510*c* is thus temporarily stored in the temperature buffer 504*a*, which allows supply of the washing water in which temperature fluctuations are reduced to the pump 13.

Figure 7:
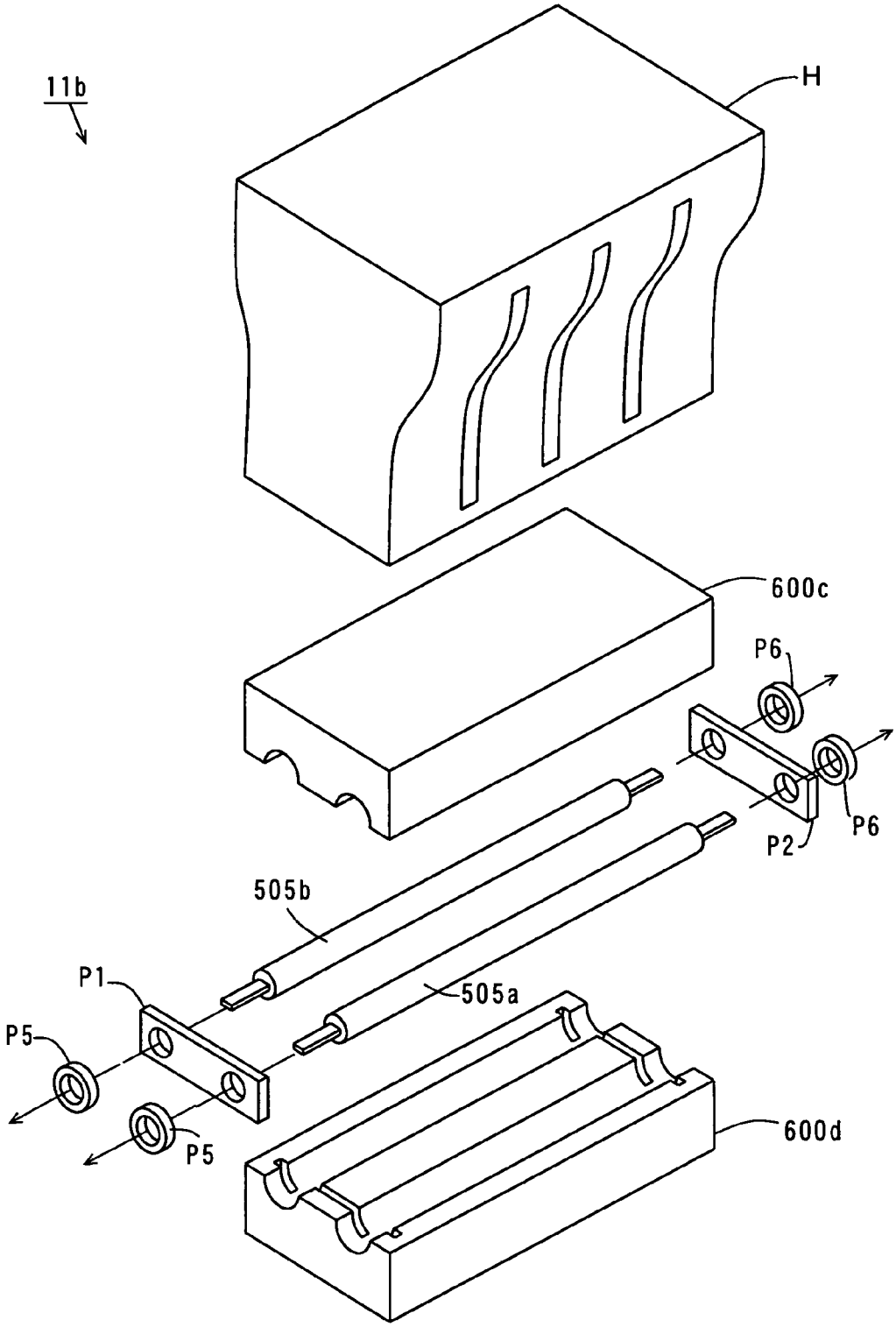
FIG. 7 is a disassembly perspective view showing still another example of the heat exchanger.

Now refer to FIG. 7 that is a disassembly perspective view showing still another example of the heat exchanger.

As shown in FIG. 7, the heat exchanger 11*b* comprises an upper case body 600*c*, a lower case body 600*d*, O rings P5, P6 as elastic holding members, plates P1, P2, and sheathed heaters 505*a*, 505*b*.

As shown in FIG. 7, the plates P1, P2 and O rings P5, P6 are mounted to the sheathed heaters 505*a*, 505*b*, followed by covering the sheathed heaters 505*a*, 505*b* with the upper case body 600*c* and the lower case body 600*d*. After that, the upper case body 600*c* and the lower case body 600*d* are welded with an ultrasonic welder H.

The upper case body 600*c* and the lower case body 600*d* in this case are made of heat resistant resins capable of ultrasonic welding. For example, thermosetting resins including an ABS resin composed of acrylonitrile, butadiene, and styrene and fiber reinforced plastics may be used.

This facilitates reduction of the assembly time of the heat exchanger 11*a* while facilitating the assembly. This also allows automatic assembly to achieve a cost reduction.

Figure 8:
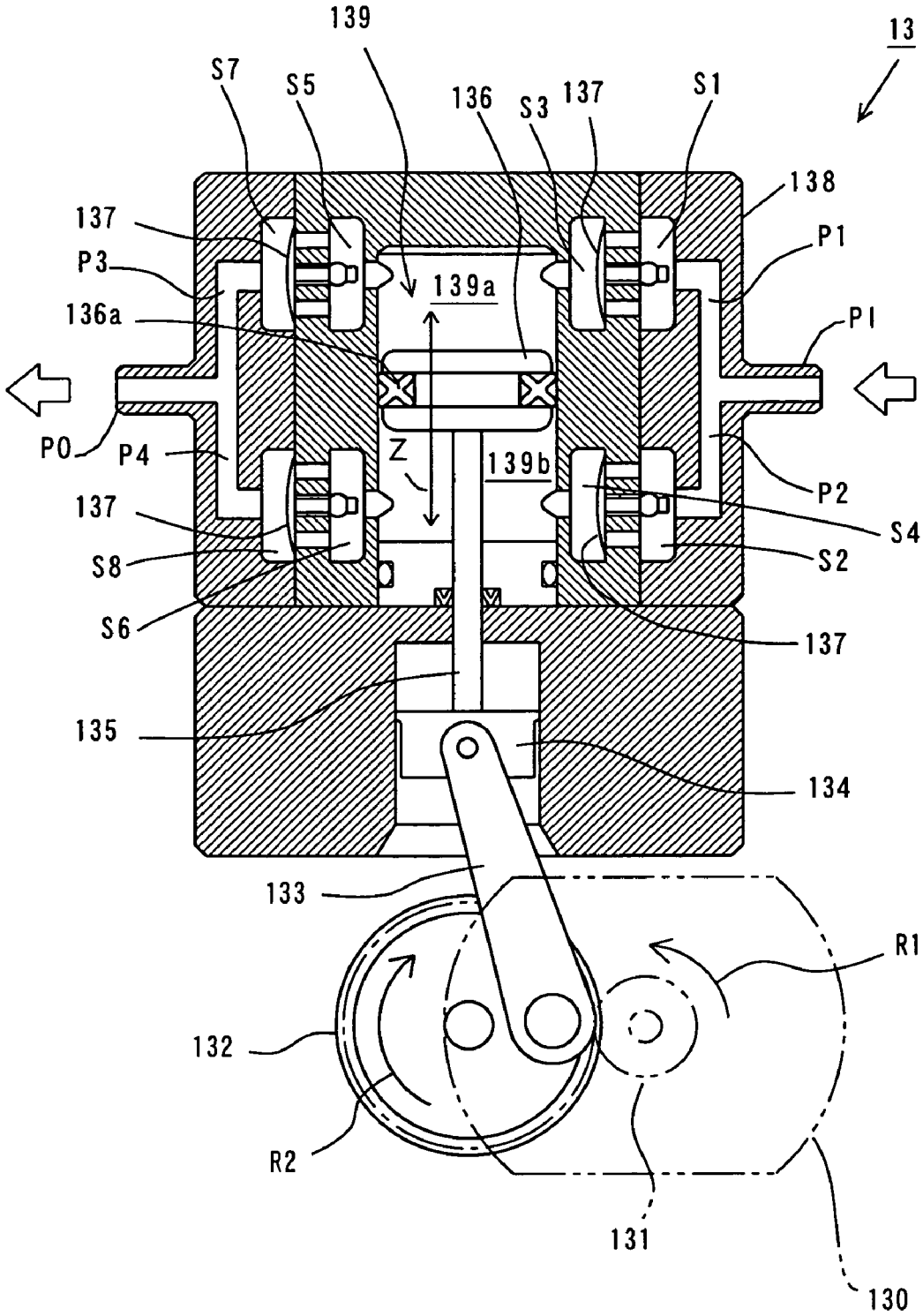
FIG. 8 is a cross section showing an example of the configuration of a pump.

FIG. 8 is a cross section showing an example of the configuration of the pump 13. The pump in FIG. 8 is a double acting reciprocating pump.

In FIG. 8, a columnar space 139 is formed in a main body 138. A pressure feeding piston 136 is arranged in the columnar space 139. An X-shaped packing 136*a* is mounted on the outer periphery of the pressure feeding piston 136. The columnar space 139 is divided by the pressure feeding piston 136 into a pump chamber 139*a* and a pump chamber 139*b*. A washing water inlet PI is arranged on one end of the main body 138, and a washing water outlet PO is arranged on the other end thereof. The washing water inlet PI is connected with the heat exchanger 11 via the pipe 203 in FIG. 3, and the washing water outlet PO is connected with the switching valve 14 via the pipe 203.

The washing water inlet PI communicates with the pump chamber 139*a* via an internal flow path P1, a small chamber S1, and a small chamber S3, and also communicates with the pump chamber 139*b* via an internal flow path P2, a small chamber S2, and a small chamber S4.

The pump chamber 139*a* communicates with the washing water outlet PO via a small chamber 5, a small chamber S7, and an internal flow path P3. The pump chamber 139*b* communicates with the washing water outlet PO via a small chamber S6, a small chamber S8, and an internal flow path P4.

Each of the small chambers S3, S4, S7, and S8 is provided with an umbrella packing 137.

A gear 131 is attached to the rotation axis of the motor 130, and a gear 132 is engaged with the gear 131. One end of a crank shaft 133 is attached to the gear 132 so as to rotate with one supporting point, while the other end of the crank shaft 133 is attached with the pressure feeding piston 136 via a piston holder 134 and a piston holding bar 135.

When the rotation axis of the motor 130 rotates based on the control signal fed from the controller 4 in FIG. 3, the gear 131 attached to the rotation axis of the motor 130 rotates in the direction of an arrow R1 while the gear 132 rotates in the direction of an arrow R2. This causes the pressure feeding piston 136 to move up and down in the direction of an arrow Z shown.

Figure 9:
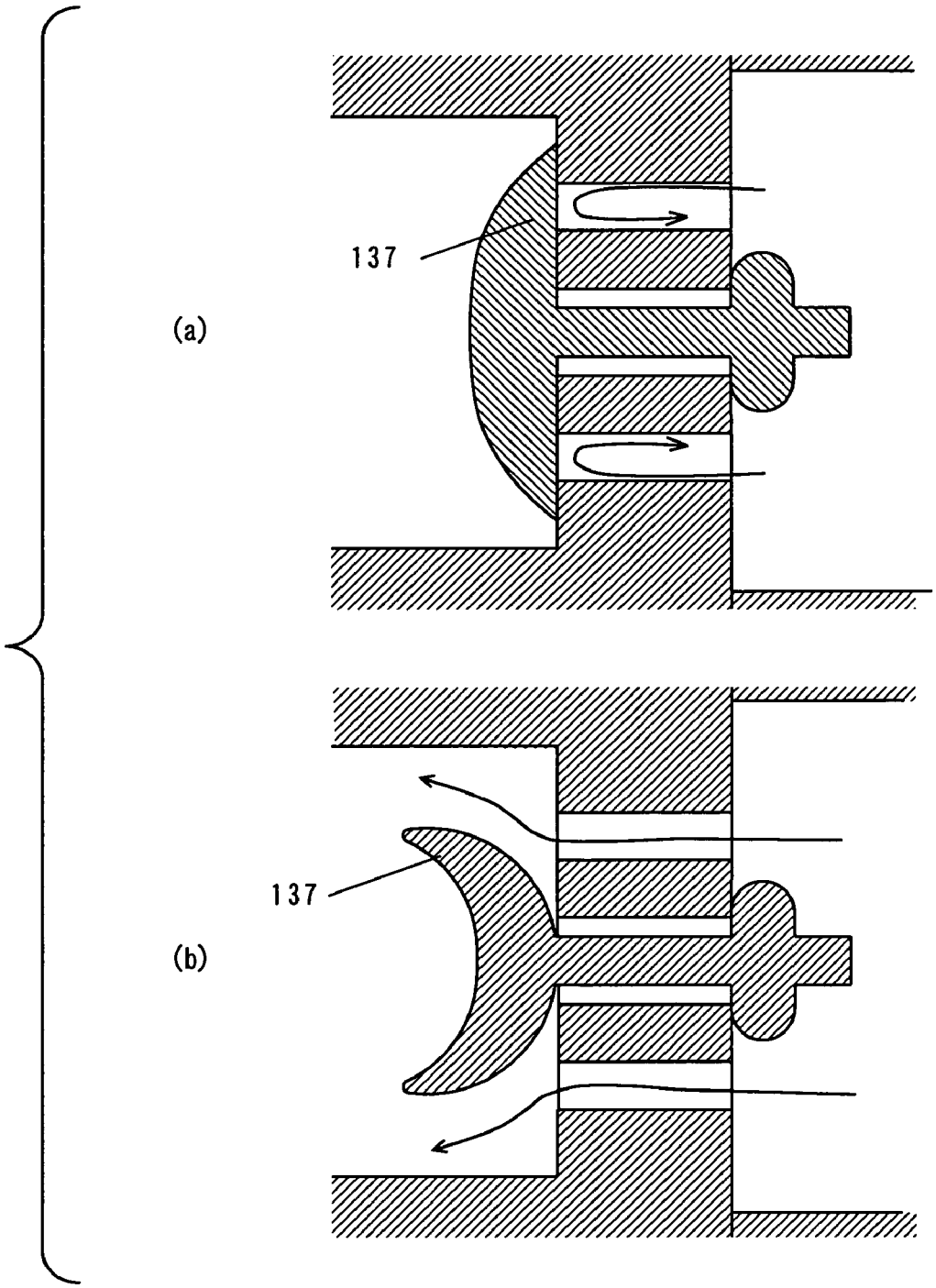
FIG. 9 is a schematic diagram for use in illustrating operations of an umbrella packing.

FIG. 9 is a schematic diagram for use in illustrating operations of an umbrella packing 137. For example, when the pressure feeding piston 136 in FIG. 8 moves downward to increase the volume of the pump chamber 139*a*, the pressure in the small chamber S1 becomes lower than the pressure in the small chamber 139*a*, causing a deformation of the umbrella packing 137 in the small chamber S3, as shown in FIG. 9(*b*). As a result, washing water supplied from the washing water inlet PI flows into the pump chamber 139*a* via the internal flow path P1, small chamber S1, and small chamber S3. In this case, the pressure in the small chamber S7 is lower than the pressure in the pump chamber 139*a*, so that the umbrella packing in the small chamber S7 does not deform from the state shown in FIG. 9(*a*). This prevents the washing water from flowing into the pump chamber 139*a* or, conversely, discharged from the washing water outlet PO.

On the other hand, when the pressure feeding piston 136 in FIG. 8 moves upward to reduce the volume of the pump chamber 139*a*, the pressure in the small chamber S1 becomes higher than the pressure in the pump chamber 139*a*, so that the umbrella packing 137 in the small chamber S3 does not deform from the state shown in FIG. 9(*a*). As a result, the washing water in the small chamber S1 does not flow into the pump chamber 139*a*. In this case, the umbrella packing 137 in the small chamber S7 deforms as shown in FIG. 9(*b*). This causes the washing water in the pump chamber 139*a* to be discharged from the washing water outlet PO via the small chamber S5, small chamber S7, and internal flow path P3.

It should be noted that the umbrella packing 137 in the small chamber S4 deforms as shown in FIG. 9(*b*) when the pressure feeding piston 136 moves upward, and does not deform from the state shown in FIG. 9(*a*) when the pressure feeding piston 136 moves downward. The umbrella packing 137 in the small chamber S8, on the other hand, does not deform from the state shown in FIG. 9(*a*) when the pressure feeding piston 136 moves upward, and deforms as shown in FIG. 9(*b*) when the pressure feeding piston 136 moves downward. Accordingly, the washing water from the washing water inlet PI flows into the pump chamber 139*b* when the washing water in the pump chamber 139*a* is discharged from the washing water outlet PO, and the washing water in the pump chamber 139*b* is discharged from the washing water outlet PO when the washing water from the washing water inlet PI flows into the pump chamber 139*a*.

Figure 10:
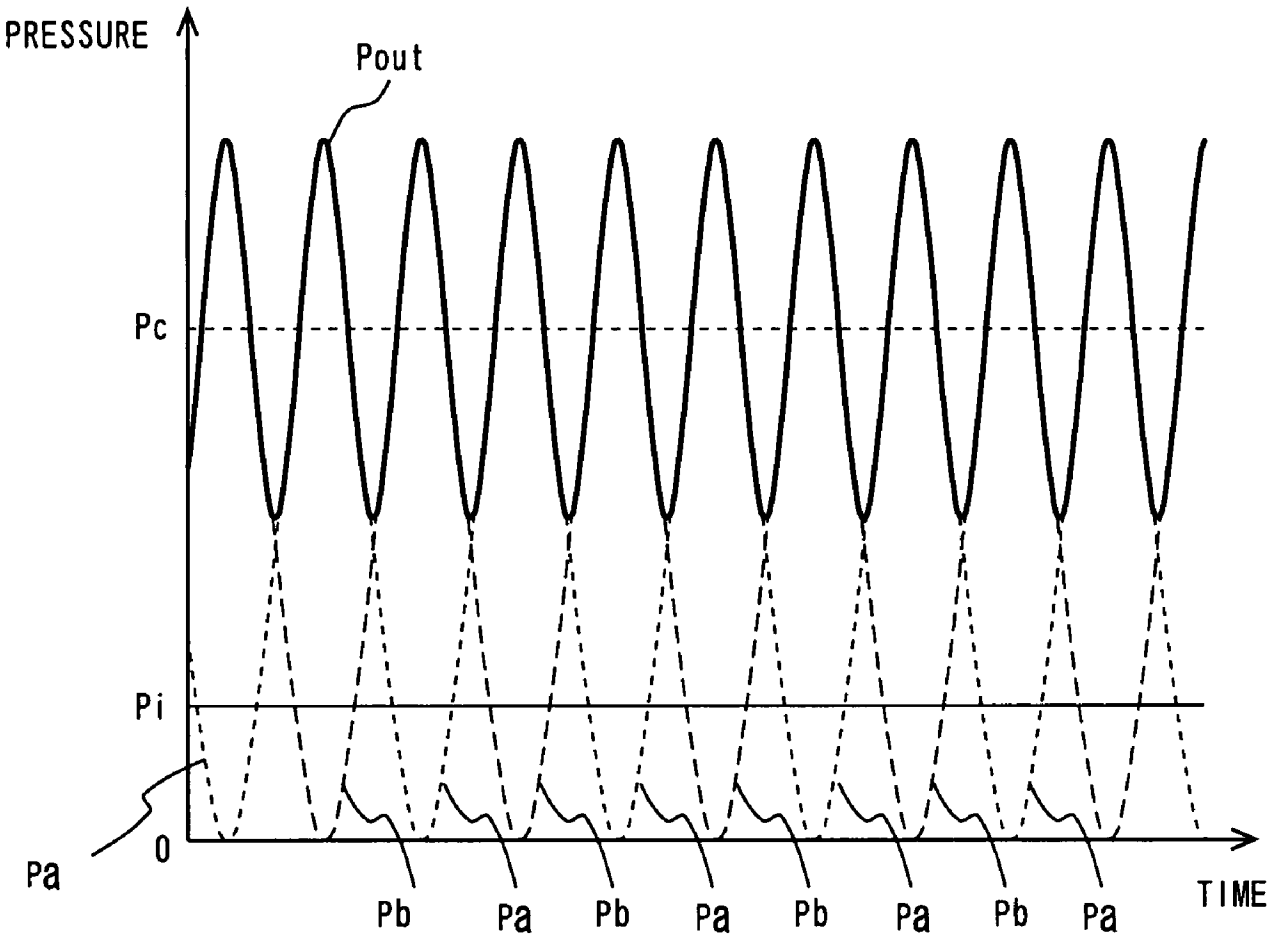
FIG. 10 is a diagram showing the change in pressure in each component of the pump of FIG. 8.

FIG. 10 is a diagram showing the change in pressure in each component of the pump 13 in FIG. 8. In FIG. 10, the ordinate represents pressure, and the abscissa represents time.

As shown in FIG. 10, washing water at a pressure Pi is supplied to the washing water inlet PI of the pump 13. In this case, the pressure feeding piston 136 in FIG. 9 moves upward and downward, causing the pressure Pa of the washing water in the pump chamber 139*a* to change as shown by the dotted line. On the other hand, the pressure Pb of the washing water in the pump chamber 139*b* changes as shown by the broken line. The pressure Pout of the washing water discharged from the washing water outlet PO of the pump 13 periodically changes upward and downward, centered at the pressure Pc, as shown by the thick solid line.

In this way, the pressure feeding piston 136 in the pump 13 moves upward and downward, causing a pressure to be alternately applied to the washing water in the pump chamber 139*a* or the pump chamber 139*b*. The pressure of the washing water at the washing water inlet PI thus increases, and the washing water is discharged from the washing water outlet PO.

Figure 11:
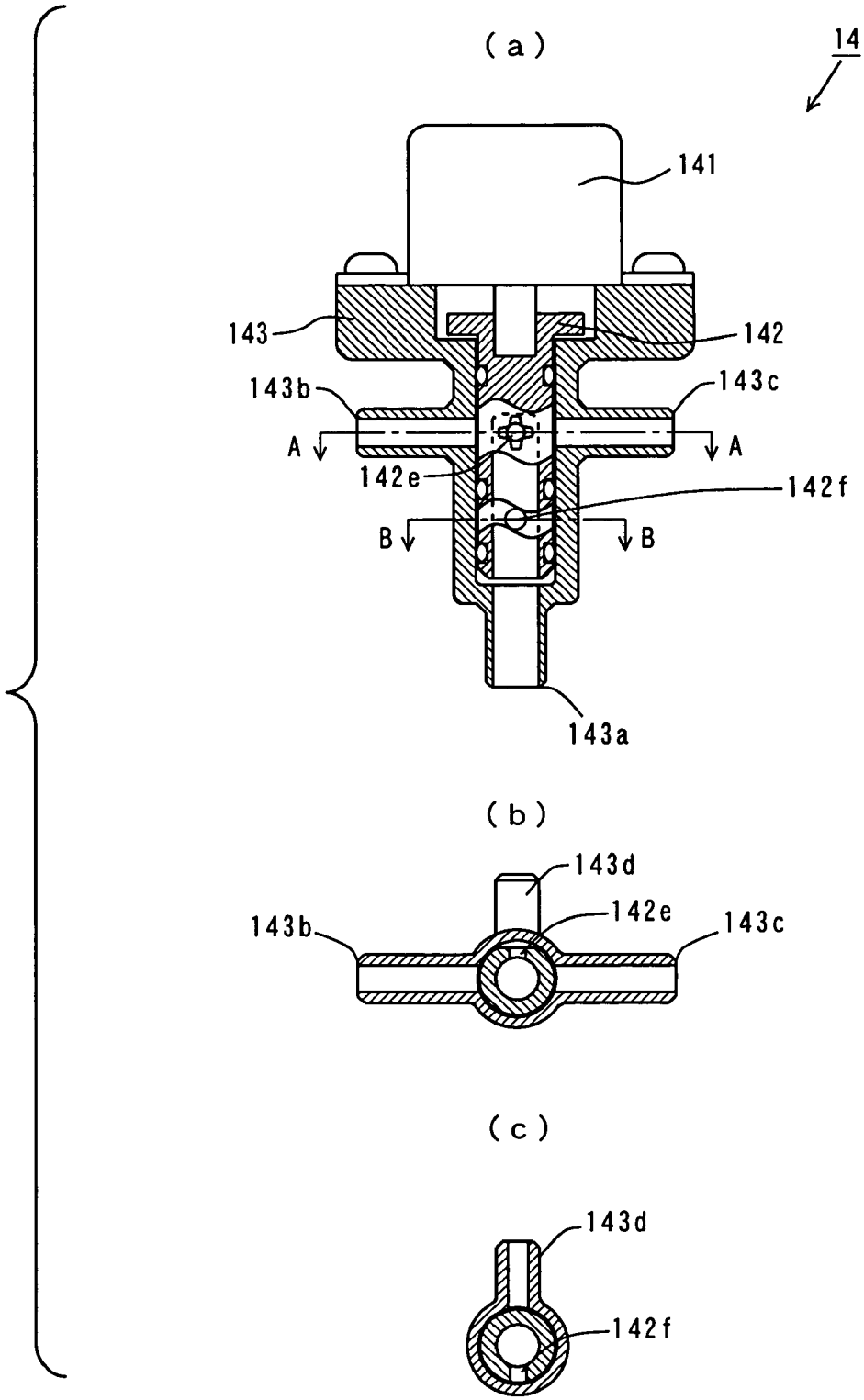
FIG. 11 is a longitudinal cross section of a switching valve, FIG. 11(*b*) is a cross section of the switching valve along the line A-A of FIG. 11(*a*), and FIG. 11(*c*) is a cross section of the switching valve along the line B-B of FIG. 11(*a*)

FIG. 11(*a*) is a longitudinal section of the switching valve 14, FIG. 11(*b*) is a cross section of the switching valve 14 along the line A-A of FIG. 11(*a*), and FIG. 11(*c*) is a cross section of the switching valve 14 along the line B-B of FIG. 11(*a*).

The switching valve 14 shown in FIG. 11 comprises a motor 141, an inner cylinder 142, and an outer cylinder 143.

The inner cylinder 142 is inserted into the outer cylinder 143, and the rotation axis of the motor 141 is attached to the inner cylinder 142. The motor 141 rotates based on the control signal fed from the controller 4. The rotation of the motor 141 causes the inner cylinder 142 to rotate.

As shown in FIG. 11(*a*), FIG. 11(*b*), and FIG. 11(*c*), a washing water inlet 143*a* is arranged on one end of the outer cylinder 143. Washing water outlets 143*b*, 143*c* are arranged opposite to each other on sides of the outer cylinder 143. A washing water outlet 143*d* is arranged in a position different from the positions of the washing water outlets 143*b*, 143*c* on the sides. Holes 142*e*, 142*f* are arranged in positions different from each other in the inner cylinder 142. A chamfer is formed around the hole 142*e*, as shown in FIG. 11(*b*). When the inner cylinder 142 rotates, the hole 142*e* can be opposed to the washing water outlet 143*b* or 143*c* in the outer cylinder 143, and the hole 142*f* can be opposed to the washing water outlet 143*d* in the outer cylinder 143.

The washing water inlet 143*a* is connected with the pipe 203 in FIG. 3, the washing water outlet 134*b* is connected with the posterior nozzle 1, the washing water outlet 143*c* is connected with the bidet nozzle 2, and the washing water outlet 143*d* is connected with the nozzle cleaning nozzle 3.

Figure 12:
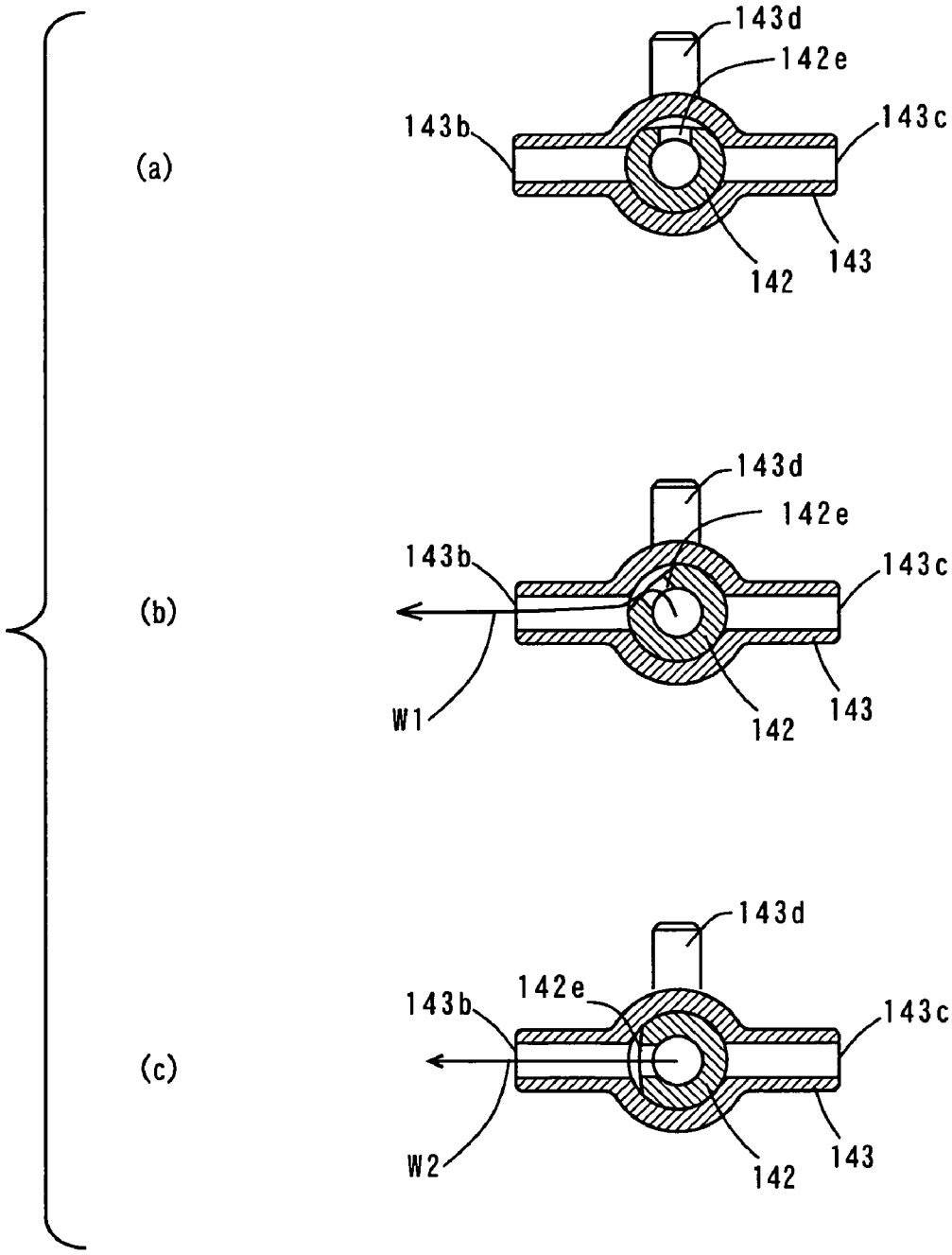
FIG. 12 is a cross section showing operations of the switching valve of FIG. 11.

FIG. 12 is a cross section showing operations of the switching valve 14 in FIG. 11.

As shown in FIG. 12(*a*), when the motor 141 is not rotating, the hole 142*e* in the inner cylinder 142 is positioned on the same side as the washing water outlet 143*d* in the outer cylinder 143. In this case, the hole 142*e* in the inner cylinder 142 is not opposed to any of the washing water outlets 143*b*, 143*c* in the outer cylinder 143, and the hole 142*f* in the inner cylinder 142 is not opposed to the washing water outlet 143*f* in the outer cylinder 143. Thus, washing water does not flow from any of the washing water outlets 143*b*, 143*c*, 143*d*.

Next, as shown in FIG. 12(*b*), when the motor 141 rotates the inner cylinder 142 through 45 degrees, a portion of the chamfer around the hole 142*e* in the inner cylinder 142 is opposed to the washing water outlet 143*b* in the outer cylinder 143. This causes a small amount of washing water to pass through the inside of the inner cylinder 142 from the washing water inlet 143*a* and flow out of the washing water outlet 143*b*, as shown by an arrow W1.

Then, as shown in FIG. 12(*c*), when the motor 141 rotates the inner cylinder 142 through 90 degrees, the hole 142*e* in the inner cylinder 142 is opposed to the washing water outlet 143*b* in the outer cylinder 143. This causes a small amount of washing water to pass through the inside of the inner cylinder 142 from the washing water inlet 143*a* and flow out of the washing water outlet 143*b*, as shown by an arrow W2.

Further, when the motor 141 rotates the inner cylinder 142 through 270 degrees, the hole 142*e* in the inner cylinder 142 is opposed to the washing water outlet 143*c* in the outer cylinder 143. This causes a large amount of washing water to pass through the inside of the inner cylinder 142 from the washing water inlet 143*a* and flow out of the washing water outlet 143*c*.

When the motor 141 rotates the inner cylinder 142 through 180 degrees, the hole 142*f* in the inner cylinder 142 is opposed to the washing water outlet 143*d* in the outer cylinder 143. This causes a large amount of washing water to pass through the inside of the inner cylinder 142 from the washing water inlet 143*a* and flow out of the washing water outlet 143*d*.

As described above, washing water flows out when the motor 141 rotates based on the control signal from the controller 4 so that either of the holes 142*e*, 142*f* in the inner cylinder 142 is opposed to any of the washing water outlets 143*b* to 143*d* in the outer cylinder 143. Conversely, no washing water flows out when neither of the holes 142*e*, 142*f* in the inner cylinder 142 is opposed to the washing water outlets 143*b* to 143*d* in the outer cylinder 143.

Figure 13:
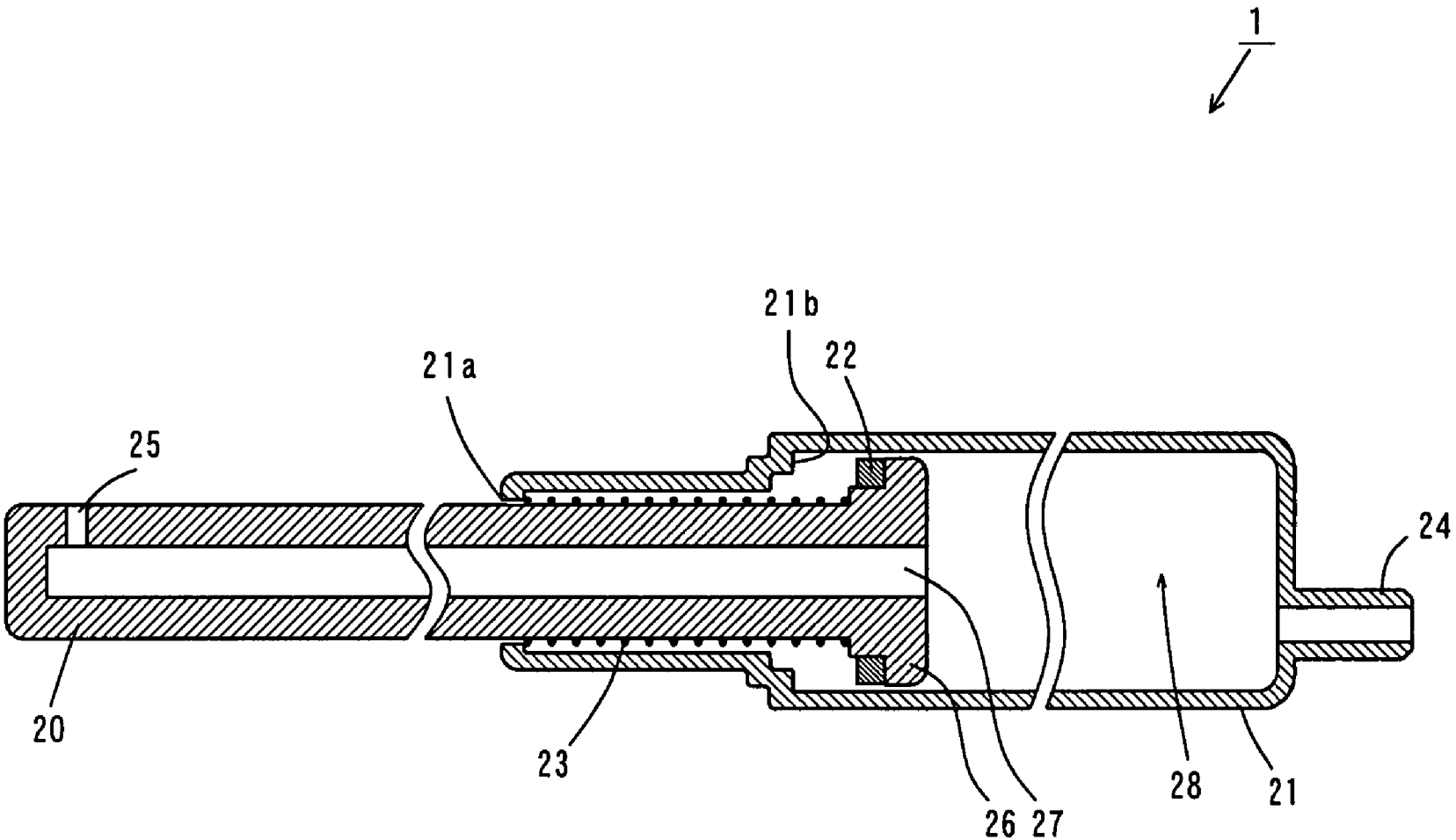
FIG. 13 is a cross section of the posterior nozzle of the nozzle unit of FIG. 3.

The posterior nozzle 1 of the nozzle unit 30 in FIG. 3 is next described. FIG. 13 is a cross section of the posterior nozzle 1 of the nozzle unit 30 in FIG. 3. The configuration and operations of the bidet nozzle 2 of the nozzle unit 30 in FIG. 3 are similar to those of the posterior nozzle 1 in FIG. 13.

As shown in FIG. 13, the posterior nozzle 1 comprises a cylindrical piston 20, a cylindrical cylinder 21, a seal packing 22, and a spring 23.

A spray hole 25 is formed near an end of the piston 20 for spraying washing water. A flange-shaped stopper 26 is arranged on a rear end of the piston 20. The seal packing 22 is mounted to the stopper 26. A flow path 27 is formed inside the piston 20 that communicates with the spray hole 25 from a rear end surface of the piston 20.

The cylinder 21 includes a small diameter portion on its forward end and a large diameter portion on its rear end. Thus, a stopper surface 21*b* is formed between the small diameter portion and the large diameter portion, with which the stopper 26 can come into contact via the seal packing 22. A washing water inlet 24 is arranged on a rear end surface of the cylinder 21, and an opening 21*a* is arranged on a forward end surface of the cylinder 21. The inner space of the cylinder 21 functions as a temperature fluctuation buffer 28. The washing water inlet 24 is arranged in an off-center position, different from the central axis of the cylinder 21. The washing water inlet 24 is connected with the washing water outlet 143*b* of the switching valve 14 in FIG. 3.

The piston 20 is movably inserted into the cylinder 21 so that the stopper 26 is positioned in the temperature fluctuation buffer 28, and the forward end of the piston 20 projects through the opening 21*a*.

The spring 23 is disposed between the stopper 26 and a peripheral edge of the opening 21*a* in the cylinder 21 to force the piston 20 toward the rear end of the cylinder 21.

A micro-clearance is formed between an outer peripheral surface of the stopper 26 in the piston 20 and an inner peripheral surface of the cylinder 21. A micro-clearance is also formed between an outer peripheral surface of the piston 20 and an inner peripheral surface of the opening 21*a*.

Figure 14:
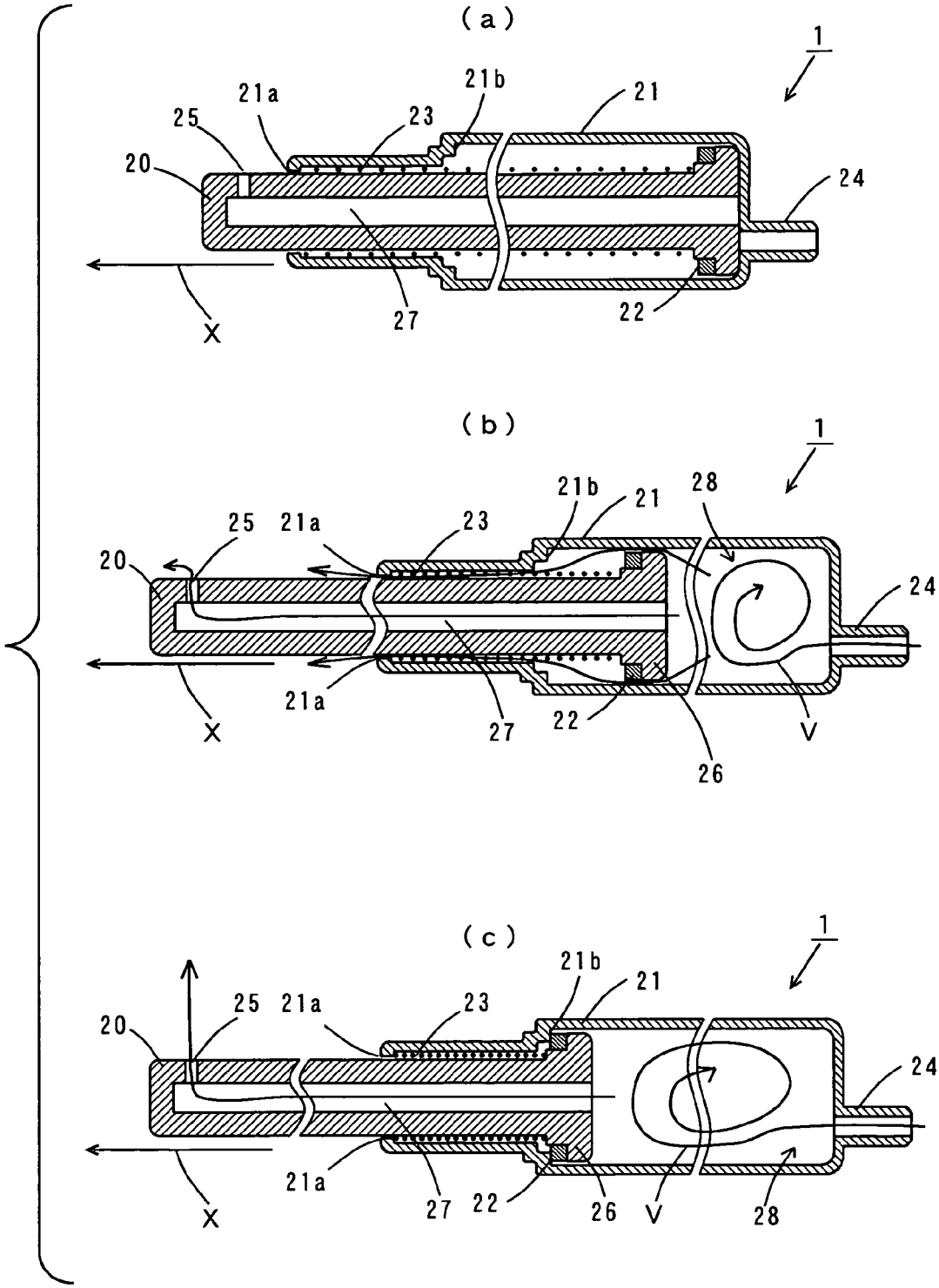
FIG. 14 is a cross section for use in illustrating operations of the posterior nozzle of FIG. 13.

Operations of the posterior nozzle 1 in FIG. 13 are next described. FIG. 14 is a cross section for use in illustrating operations of the posterior nozzle 1 in FIG. 13.

To begin with, when no washing water is supplied from the washing water inlet 24 of the cylinder 21 as shown in FIG. 14(*a*), the piston 20 retreats in a direction opposite to the direction of an arrow X by the elastic force of the spring 23, and accommodated in the cylinder 21. As a result, the piston 20 is least projecting from the opening 21*a* in the cylinder 21. At the time, the temperature fluctuation buffer 28 is not formed in the cylinder 21.

When the supply of washing water from the washing water inlet 24 of the cylinder 21 is then started, as shown in FIG. 14(*b*), the pressure of the washing water causes the piston 20 to gradually advance in the direction of the arrow X against the elastic force of the spring 23. Accordingly, the temperature fluctuation buffer 28 is formed in the cylinder 21 while the washing water flows into the temperature fluctuation buffer 28.

Since the washing water inlet 24 is arranged in a position off-center from the central axis of the cylinder 21, the washing water flown into the temperature fluctuation buffer 28 flows in a swirling manner, as shown by an arrow V. Some of the washing water in the temperature fluctuation buffer 28 passes through the micro-clearance between the outer peripheral surface of the stopper 26 in the piston 20 and the inner peripheral surface of the cylinder 21, and flows out of the micro-clearance between the outer peripheral surface of the piston 20 and the inner peripheral surface of the opening 21*a* in the cylinder 21 to be sprayed from the spray hole 25.

When the piston 20 advances further, as shown in FIG. 14(*c*), the stopper 26 comes into watertight contact with a stopper surface 21*b* in the cylinder 21 via the seal packing 22. This blocks off a flow path leading from the micro-clearance between the outer peripheral surface of the stopper 26 in the piston 20 and the inner peripheral surface of the cylinder 21 to the micro-clearance between the outer peripheral surface of the piston 20 and the inner peripheral surface of the opening 21*a* in the cylinder 21. This causes the washing water in the temperature fluctuation buffer 28 to be sprayed only from the spray hole 25 via the flow path 27 in the piston 20.

As described above, the washing water supplied from the heat exchanger 11 in FIG. 3 is stored in the temperature fluctuation buffer 28 in the cylinder 21 before being sprayed from the spray hole 25 via the flow path 27 in the piston 20. This allows fluctuations in the temperature of the washing water to be buffered in the temperature fluctuation buffer 28. In this way, temperature fluctuations of the washing water sprayed from the spray hole 25 are smoothed out, resulting in reductions in abrupt temperature fluctuations.

In particular, since the washing water inlet 24 is arranged in a position off-center from the central axis of the cylinder 21, the washing water flows in a swirling manner in the temperature fluctuation buffer 28. This allows the temperature fluctuations of the washing water to be efficiently buffered. Accordingly, even when the volume of the temperature fluctuation buffer 28 is small, a high buffering effect is achieved on the temperature fluctuations of the washing water.

Figure 15:
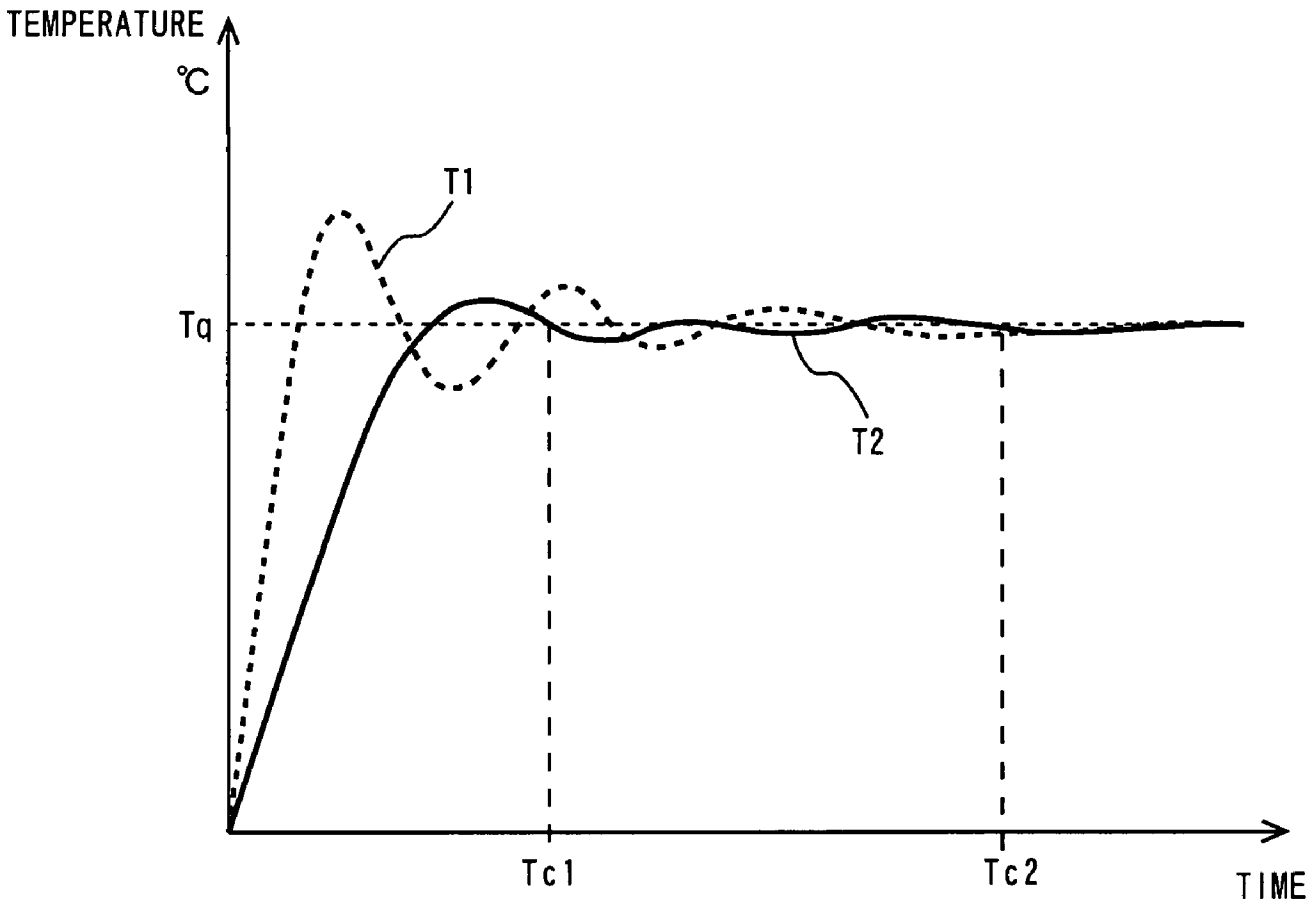
FIG. 15 is a diagram showing the change in the temperature of the washing water discharged from the heat exchanger and the change in the temperature of the washing water sprayed from the posterior nozzle at the beginning of washing.
Figure 16:
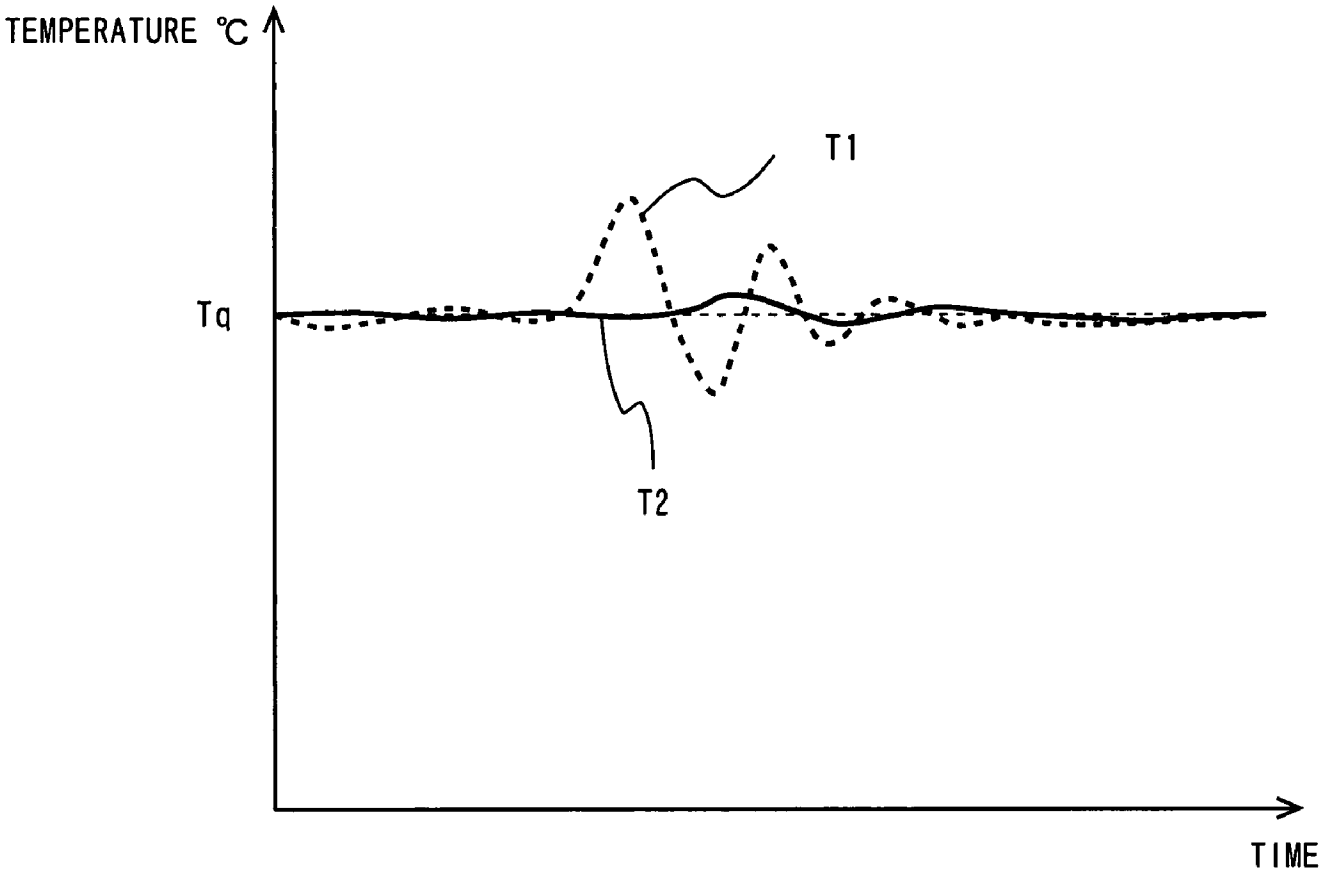
FIG. 16 is a diagram showing the change in the temperature of the washing water discharged from the heat exchanger and the change in the temperature of the washing water sprayed from the posterior nozzle when there is an instantaneous temperature fluctuation in the heat exchanger.

FIG. 15 is a diagram showing the change in the temperature of the washing water discharged from the heat exchanger 11 and the change in the temperature of the washing water sprayed from the posterior nozzle 1 at the beginning of washing. FIG. 16 is a diagram showing the change in the temperature of the washing water discharged from the heat exchanger 11 and the change in the temperature of the washing water sprayed from the posterior nozzle 1 when there is an instantaneous temperature fluctuation in the heat exchanger 11.

In each of FIG. 15 and FIG. 16, the ordinate represents the temperature of washing water, and the abscissa represents time. Also, the broken line represents a temperature T1 of the washing water discharged from the discharge port 512 of the heat exchanger 11, and the solid line represents a temperature T2 of the washing water sprayed from the spray hole 25 of the posterior nozzle 1.

As shown in FIG. 15, at the beginning of washing, the temperature T1 of the washing water discharged from the discharge port 512 of the heat exchanger 11 greatly overshoots a set temperature Tq. Then, after the elapse of a given time Tc2, the temperature T1 becomes stable at the set temperature Tq. On the other hand, the temperature T2 of the washing water sprayed from the spray hole 25 of the posterior nozzle 1 becomes stable approximately at the set temperature Tq in a time Tc1 shorter than the time Tc2, because the temperature fluctuations are buffered in the temperature fluctuation buffer 28.

As shown in FIG. 16, when the temperature in the heat exchanger 11 instantaneously fluctuates greatly, the temperature T1 of the washing water discharged from the discharge port 512 of the heat exchanger 11 instantaneously fluctuates greatly. In this case, the temperature of the washing water discharged from the discharge port 512 of the heat exchanger 11 becomes stable approximately at the set temperature Tq after the elapse of a response delay time T due to the control of the controller 4.

On the other hand, the temperature T2 of the washing water sprayed from the spray hole 25 of the posterior nozzle 1 is hardly changed, and remains stable at approximately the set temperature Tq, because the temperature fluctuations are buffered in the temperature fluctuation buffer 28.

In order to reliably prevent very hot water from being sprayed from the spray hole 25 of the posterior nozzle 1 even with a sudden increase in the temperature of the washing water heated by the heat exchanger 11, it is preferred to set the volume of the temperature fluctuation buffer 28 in the cylinder 21 to not less than the product of the response delay time T of the controller 4 and the maximum flow rate Qmax of the washing water flowing in the pipe 203 per unit time. As mentioned here, the response delay time T is the time between the instant at which the temperature of the washing water heated by the heat exchanger 11 increases to a predetermined value or greater, followed by the detection of the temperature of the washing water discharged from the heat exchanger 11 by the temperature sensor 12*b*, and the instant at which the supply of the washing water is stopped by the stop solenoid valve 9 under the control of the controller 4.

According to the foregoing, in each of the heat exchangers 11, 11*a*, 11*b* in this embodiment, the heating element and the case body can be prevented from deformation and damage even if the heating element thermally expands or contracts.

Moreover, in the sanitary washing apparatus 100 using the heat exchanger 11, 11*a* or 11*b* in this embodiment, washing water is heated only during the use of the sanitary washing apparatus, so that the power consumption can be minimized. Further, a storage tank for storing the washing water is not required, thus resulting in space savings.

In addition, when the sanitary washing apparatus 100 is not being used, it is not necessary to supply power to the heat exchanger 11, thereby reducing the power consumption. Further, washing water is heated while being supplied to the cylindrical space 510*a*, 510*b*, and 510*c* in the heat exchanger 11, preventing a decrease in the temperature of the washing water even if the amount of usage thereof is large.

Moreover, there is no need to store the washing water for a long time to keep it warm, allowing the sprayed washing water to be always fresh during the use of the sanitary washing apparatus 100. This is preferable in terms of sanitation.

Although the embodiment describes the use of the heat exchangers 11, 11*a*, 11*b* in the instantaneous heating type sanitary washing apparatus, the heat exchangers 11, 11*a*, 11*b* may be used in a storage type sanitary washing apparatus, for example.

In the embodiment, the rectangular case body 600, the end surface members 600*a*, 600*b*, the upper case body 600*c*, and the lower case body 600*d* correspond to a case body; the sheathed heaters 505*a*, 505*b* correspond to a heating element; the O rings P5 as the elastic holding members correspond to a first holding member; the O rings P6 as the elastic holding members correspond to a second holding member; the cylindrical spaces 510*a*, 510*b*, 510*c* correspond to a flow path allowing flow of liquid; the washing water inlet 511 corresponds to a first liquid port; the washing water outlet 512 corresponds to a second liquid port; the temperature sensor 12*a* corresponds to a temperature detector; the temperature buffer 504*a* corresponds to a temperature buffer; the elastic holding members P5, P6 correspond to a first elastic body and a second elastic body, respectively; the thermostat 12*b* or the temperature fuse 12*c* corresponds to an overheat preventing device; the heat exchangers 11, 11*a*, 11*b* correspond to a heating device; and the posterior nozzle 1, the bidet nozzle 2, the nozzle cleaning nozzle 3, and the nozzle unit 30 correspond to a spraying device.

Although the embodiment describes the use of a double acting reciprocating pump as the pump 13, a rotary pump or other reciprocating pump may also be used, for example.

The invention claimed is:

1. A heating device comprising:

a case body;

a heating element having a first end and a second end opposite to the first end;

a first holding member that holds said first end of said heating element to said case body; and a second holding member that holds said second end of said heating element to said case body, wherein said heating element is configured to move in an axial direction along an axis of the heating element while in operation and while being restrained from moving in a radial direction by the first holding member and the second holding member.

2. The heating device according to claim 1, wherein a flow path that allows flow of liquid is formed between said case body and an outer peripheral surface of said heating element.

3. The heating device according to claim 1, wherein a first liquid port and a second liquid port that communicate with said flow path are formed in said case body.

4. The heating device according to claim 1, wherein said first liquid port in said case body is provided in a position off-center from the central axis of said heating element.

5. The heating device according to claim 1, further comprising:

a temperature detector that is provided near said second liquid port in said case body.

6. The heating device according to claim 1, further comprising:

a temperature buffer that is provided in said case body to communicate with said second liquid port.

7. The heating device according to claim 1, wherein said heating element is formed in a columnar shape.

8. The heating device according to claim 1, wherein said heating element includes a sheathed heater.

9. The heating device according to claim 1, wherein said heating element includes a ceramic heater.

10. The heating device according to claim 1, wherein said heating element includes a plurality of substantially linear-shaped heating elements, and wherein said plurality of heating elements are provided in parallel to pass through said case body.

11. The heating device according to claim 1, wherein each of said first holding member and said second holding member is composed of an elastic body.

12. The heating device according to claim 1, wherein said case body is formed by integrating a plurality of case portions.

13. The heating device according to claim 12, wherein said plurality of case portions are made of resins, and integrated by being bonded by welding.

14. The heating device according to claim 1, further comprising:

an overheat preventing device for preventing said heating element from overheating.

15. A sanitary washing apparatus for spraying washing water supplied from a water supply source to a portion of a human body to be washed, comprising:

a heating device that heats said washing water supplied from said water supply source while causing said washing water to flow; and a spraying device that sprays said washing water heated by said heating device to said human body, wherein said heating device comprises:

a case body;

a heating element having a first end and a second end opposite to the first end;

a first holding member that holds said first end of said heating element to said case body; and a second holding member that holds said second end of said heating element to said case body, wherein said heating element is configured to move in an axial direction along an axis of the heating element while in operation and while being restrained from moving in a radial direction by the first holding member and the second holding member.

* * * * *

UNITED STATES PATENT AND TRADEMARK OFFICE

CERTIFICATE OF CORRECTION

PATENT NO. : 7,834,294 B2
APPLICATION NO. : 10/547388
DATED : November 16, 2010
INVENTOR(S) : S. Shirai et al.

It is certified that error appears in the above-identified patent and that said Letters Patent is hereby corrected as shown below:

On cover page item (56) References Cited (page 1, line 13-14) replace "A partial English language translation of Japanese Laid-Open Utility Model No. HEI 6-82715" with --A partial English language translation of Japanese Laid-Open Utility Model No. HEI 6-82175--.

On cover page, item (56) References Cited (page 2, line 4) delete "7-098152".

On cover page, item (56) References Cited (page 2, line 7) delete "2000-038757".

On cover page, item (56) References Cited (page 2, line 9) delete "2000-064399".

Signed and Sealed this
Fifth Day of April, 2011

David J. Kappos

David J. Kappos
*Director of the United States Patent and Trademark Office*